US012714216B2

(12) United States Patent
Hatch et al.

(10) Patent No.: US 12,714,216 B2
(45) Date of Patent: Aug. 25, 2026

(54) STABILIZED, PRECISION, DUAL-BRUSH EYELASH APPLICATION APPARATUS AND METHOD

(71) Applicant: Lash Duet, LLC, Orem, UT (US)

(72) Inventors: Lisa Hatch, Orem, UT (US); Gerald Zinnbauer, Cornelius, NC (US)

(73) Assignee: Lash Duet, LLC, Orem, UT (US)

( * ) Notice: Subject to any disclaimer, the term of this patent is extended or adjusted under 35 U.S.C. 154(b) by 0 days.

(21) Appl. No.: 18/899,779

(22) Filed: Sep. 27, 2024

(65) Prior Publication Data

US 2025/0185785 A1 Jun. 12, 2025

Related U.S. Application Data

(60) Division of application No. 17/942,970, filed on Sep. 12, 2022, now Pat. No. 12,102,210, which is a (Continued)

(51) Int. Cl.
*A45D 40/26* (2006.01)
*A45D 34/04* (2006.01)
(Continued)

(52) U.S. Cl.
CPC ..... *A45D 40/262* (2013.01); *A45D 34/042* (2013.01); *A45D 40/24* (2013.01);
(Continued)

(58) Field of Classification Search
CPC ..... A45D 2/48; A45D 34/046; A45D 40/262; A45D 40/265; A46B 2200/1053; A46B 2200/106
See application file for complete search history.

(56) References Cited

U.S. PATENT DOCUMENTS 2,634,728 A 4/1953 Dale
4,437,477 A * 3/1984 Gueret ..... A45D 40/267 401/128
(Continued)

FOREIGN PATENT DOCUMENTS

CA 2893075 A1 4/2014
CN 202179264 U 4/2012
(Continued)

*Primary Examiner* — David P Angwin
*Assistant Examiner* — Bradley S Oliver
(74) *Attorney, Agent, or Firm* — Morriss O'Bryant Compagni Cannon, PLLC

(57) ABSTRACT

A mascara application system includes two brushes on wands, biased together, requiring force by fingers to separate brushes. Once open or separated, brushes can be positioned on opposite sides (surfaces, top and bottom) of an eyelash (speaking of the entire lash, not individual fibers). Upon release of the force, brushes close on each other, with no affirmative force required to keep them together, fingers now free to manipulate by holding, rolling, drawing, or otherwise controlling the handle portion. A receptacle portion containing mascara product may receive, and seal the applicator with or without relative rotation, depending on the embodiment. The best functional embodiment requires no rotation of the squeegee seal, but instead causes the squeegee to move brushes and wands radially outward with limited movement (toggling) in almost any direction when partially withdrawn through the squeegee.

19 Claims, 30 Drawing Sheets

Related U.S. Application Data continuation-in-part of application No. 16/598,376, filed on Oct. 10, 2019, now Pat. No. 11,439,221, which is a division of application No. 15/898,118, filed on Feb. 15, 2018, now Pat. No. 10,441,054, which is a division of application No. 15/623,719, filed on Jun. 15, 2017, now Pat. No. 10,278,475, which is a division of application No. 15/099,124, filed on Apr. 14, 2016, now Pat. No. 9,681,734, which is a division of application No. 14/046,760, filed on Oct. 4, 2013, now Pat. No. 9,314,085.

(60) Provisional application No. 62/459,562, filed on Feb. 15, 2017, provisional application No. 61/709,845, filed on Oct. 4, 2012.

(51) Int. Cl.
*A45D 40/24* (2006.01)
*A46B 5/00* (2006.01)

(52) U.S. Cl.
CPC ..... *A45D 40/265* (2013.01); *A45D 40/267* (2013.01); *A46B 5/0012* (2013.01); *A46B 2200/1053* (2013.01)

(56) References Cited

U.S. PATENT DOCUMENTS

| | | | | |
|---|---|---|---|---|
| 4,458,701 | A * | 7/1984 | Holland | A46B 5/0012 132/218 |
| 4,830,030 | A | 5/1989 | Bush et al. | |
| 5,052,839 | A | 10/1991 | Pettengill | |
| 5,176,156 | A | 1/1993 | Ashtary et al. | |
| 5,324,128 | A * | 6/1994 | Gueret | A45D 34/046 401/122 |
| 5,662,659 | A | 9/1997 | McDonald | |
| 6,029,675 | A | 2/2000 | Dumler | |
| 6,120,202 | A | 9/2000 | Donsky | |
| 6,352,293 | B1 | 3/2002 | Baschenis | |
| 6,916,054 | B1 | 7/2005 | Baldesberger | |
| 7,429,141 | B2 | 9/2008 | Habatjou | |
| 8,851,775 | B2 * | 10/2014 | Jacob | A45D 40/26 401/122 |
| 9,314,085 | B2 | 4/2016 | Hatch | |
| 9,681,734 | B2 | 6/2017 | Hatch | |
| 9,730,503 | B2 | 8/2017 | Moon | |
| 10,278,475 | B2 | 5/2019 | Hatch | |
| 10,441,054 | B2 | 10/2019 | Hatch et al. | |
| 2008/0006287 | A1 | 1/2008 | Gueret | |
| 2010/0089414 | A1 | 4/2010 | Wyatt et al. | |
| 2010/0095975 | A1 * | 4/2010 | Kim | A45D 40/265 132/218 |
| 2010/0242981 | A1 | 9/2010 | Bouix et al. | |
| 2010/0300473 | A1 * | 12/2010 | Kim | A46B 7/023 132/218 |
| 2011/0293352 | A1 | 12/2011 | Kim | |

FOREIGN PATENT DOCUMENTS

| | | | | |
|---|---|---|---|---|
| DE | 202011100182 | U1 | 8/2012 | |
| EP | 1652449 | A2 | 5/2006 | |
| EP | 2903477 | A1 | 8/2015 | |
| GB | 2404577 | A | 9/2005 | |
| GB | 2516622 | A | 4/2015 | |
| WO | WO-2004077987 | A1 * | 9/2004 | A45D 2/48 |
| WO | 2010117832 | A2 | 10/2010 | |

* cited by examiner

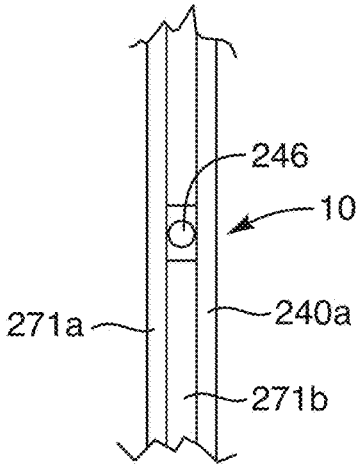
FIG. 19
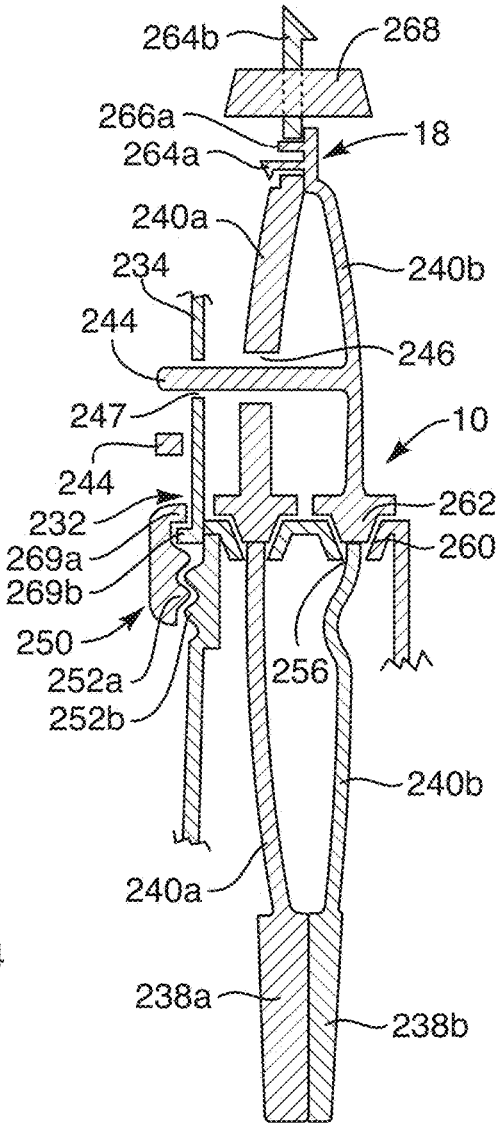
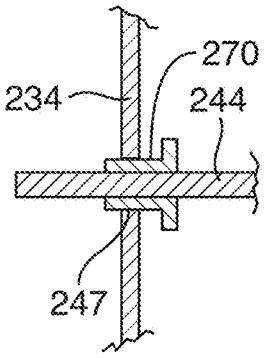
FIG. 20
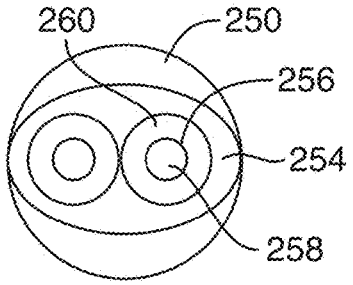
FIG. 21
FIG. 18
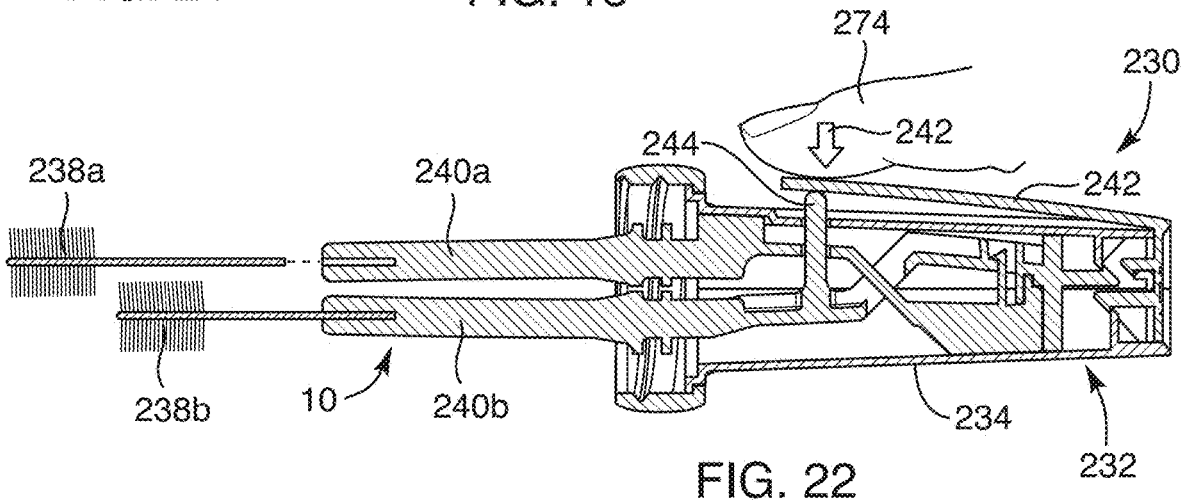
FIG. 22

Section A-A

STABILIZED, PRECISION, DUAL-BRUSH EYELASH APPLICATION APPARATUS AND METHOD

CROSS-REFERENCE TO RELATED APPLICATIONS

This application: is a divisional of U.S. patent application Ser. No. 17/942,970, filed Sep. 12, 2022; which is a continuation-in-part of U.S. patent application Ser. No. 16/598,376, scheduled to issue as U.S. Pat. No. 11,439,221 on Sep. 13, 2022; which is a divisional of U.S. patent application Ser. No. 15/898,118, filed Feb. 15, 2018 and issued as U.S. Pat. No. 10,441,054 on Oct. 15, 2019; which is a divisional of U.S. patent application Ser. No. 15/623,719, filed Jun. 15, 2017, and issued as U.S. Pat. No. 10,278,475 on May 7, 2019; which is a divisional of U.S. patent application Ser. No. 15/099,124, filed Apr. 14, 2016, issued as U.S. Pat. No. 9,681,734 on Jun. 20, 2017; which is a divisional of U.S. patent application Ser. No. 14/046,760, filed Oct. 4, 2013 and issued as U.S. Pat. No. 9,314,085 on Apr. 19, 2016, which claims the benefit of U.S. Provisional Patent Application Ser. No. 61/709,845, filed Oct. 4, 2012 and claims the benefit of U.S. Provisional Patent Application Ser. No. 62/459,562 filed Feb. 15, 2017. All of the foregoing are hereby incorporated herein by reference in their entireties.

THE FIELD OF THE INVENTION

This disclosure relates generally to cosmetics and, more specifically, to mascara applicators and containers.

BACKGROUND OF THE INVENTION

Mascara use dates back to 4000 B.C. in ancient Egypt. Originally, mascara was applied to eyelashes with applicators made of bone and ivory. The modern applicator wand was developed in the 1960s, and efforts have continued to make better applicators. Various types of brushes have been devised. Fat brushes create voluptuous, voluminous lashes; skinny brushes coat each lash perfectly while separating and not clumping (adhering together individual lash hairs, fibers); and curved wands help curl lashes.

Many technological advances have shaped the industry, from adding fibers or supplementing formulations with collagen and keratin, to creating uniquely shaped brushes, to "notice-me" packaging that enhances product attributes and entices consumers to purchase. However, the basic structure of a wand applicator, with a single brush, has remained essentially unchanged. Accordingly, the proper application of mascara typically involves separately coating the upper and under sides of a top lash, using only one wand and one brush.

Mascara is the universally, most-preferred cosmetic. It is also the most time-consuming cosmetic to adequately apply. The three main features a consumer wants from her mascara and applicator are volume, length and separation, each of which may require a different type of applicator. Some cosmetic companies offer dual-ended mascara containers, with one brush on either end to try to facilitate different ones of these three purposes.

SUMMARY OF THE INVENTION

This disclosure relates to mascara application systems that include applicators with two brushes. Mascara is held in a receptacle portion of a container into which brushes are inserted to be loaded with mascara. Applicators with handle portions, held in a cap portion of the container, space the brushes apart from one another when pressure is applied to the handle portion. The brushes are positioned adjacent to one another, actually interleaving, when no pressure is applied to counter the bias force tending to push the brushes together. This countering force may be applied by a user to the handle portion or to the wands holding the brushes.

A dual brush mascara applicator according to one embodiment comprises a handle including a first arm and a second arm. At one end, each of the first arm and the second arm includes a handle portion. At the opposite end, each of the first arm and the second arm includes an applicator end. A first mascara brush is positioned at or on the applicator end of the first arm, and a second mascara brush is positioned at or on the applicator end of the second arm. The first arm crosses the second arm so that transverse movement of the handle portion of the first arm relative to the handle portion of the second arm causes an opposite transverse movement of the first brush relative to the second brush.

Alternatively, a pair of uncrossed arms may be biased toward one another. This may provide less material available to deflect, causing early failure.

The dual brush mascara applicator may further include a mascara container including a first opening for the first brush, a second opening for the second brush, and squeegee attachments associated with the first and second openings for removing excess mascara from the first and second brushes.

The dual brush mascara applicator may also include an applicator container for the handle portions of the first and second arms. The applicator container may include a movable member for applying transverse force to the first arm and/or the second arm to cause transverse movement of the first arm and/or the second arm.

Methods for applying mascara are also disclosed. In such a method, with the brushes in an open arrangement (i.e., spaced apart from one another), they may be placed on opposite sides of lashes to which mascara is to be applied. Once the brushes are in place, they may be placed in a closed arrangement (i.e., against one another), enabling the two brushes to engage the lashes, and to work together for easy application of mascara to the eyelashes.

Other features, as well as various features and advantages, of the disclosed subject matter will become apparent to those of ordinary skill in the art through consideration of the ensuing description, the accompanying drawings and the appended claims.

As used herein, the terms "reverse tweezers" or "reverse action" refer to apparatuses that include a mechanism that causes separate tips at one end of the apparatus to move away from one another as corresponding handle portions at an opposite end of the apparatus are pushed transversely towards each other. Conversely, the release of the transverse force that was pushing adjacent handle portions of the apparatus together results in causing movement of the tips of the apparatus towards each other.

A mascara applicator that incorporates these features includes two brushes mounted on a handle that operates by a reverse tweezers action. Each of the arms of the handle includes a handle portion at one end and a wand at the other end. The brushes of such an applicator, which are located at ends of the wands, may work together in tandem to simultaneously apply mascara to the upper and under sides of a top lash.

Mascara may be applied to the brushes in a mascara container that has separate, adjacent (e.g., parallel, etc.)

ports to accept each wand and its corresponding brush. In the reverse tweezers mechanism, the two wands are connected together so that the brushes are normally (when the applicator arms are in a relaxed state) in a closed arrangement, where they may be nestled together, and the wands may be moved apart from each other as a user squeezes the handle portions of the arms together.

Thus, wands and brushes move apart from one another, or open, when pressure is applied to the handle portions, and the brush ends move towards one another, or close, when the pressure on the handle portions is released.

The two-brush reverse action apparatus of the present invention enables a user to spread the brushes to accept an eyelash and then release the pressure on the arms, so that the brushes return to their closed nestled position applying a steady pressure to the brushes in contact with the eyelash. The user may then smoothly pull the mascara applicator forward and upward, away from her lashes, leaving a residue of mascara on either side of her lashes. This action is repeated as necessary to achieve a desired appearance. The apparatus also enables a user to achieve desired amounts of volume, length and separation of their lashes, using a combination of brush shapes, styles and mediums on the ends of the wands.

The present disclosure also provides for a movable outer container, which is also referred to herein as an "applicator container," for the handle portions of the arms of the reverse action applicator. The applicator container has movable parts so that when pressure is applied the handle portions of the arms, the reverse action mechanism is actuated to move the wands and brushes away from each other. When the pressure is released, the reverse action mechanism is deactuated, enabling the wands and brushes to move back together.

The movable container may include one or more movable members that actuate(s) one or both of the handle portions of the applicator. In some embodiments, the movable members may define pressure points on the container that, when pushed or pressed together, move the handle portions of the arms of the applicator. This action opens the wands for positioning the brushes over the user's lashes. Thereafter, when the user releases the pressure on the movable member (s) of the applicator container, the wands of the applicator may close, bringing the brushes together.

A mascara container may have a dual portal with dual squeegees to house to contain the dual wands of the applicator when the applicator is not in use or when the application of mascara to the brushes is desired. These dual portals enable the dual wands and brushes to slide in and out of the portals. Each portal may include a squeegee member that removes any excess mascara from its corresponding brush as the wands are pulled from the mascara container. The squeegee members may also help seal the mascara from the surrounding air when the wands of the applicator have been removed to apply mascara, as well as when the wands of the applicator are housed in the portals.

Alternative embodiments may include additional benefits such as registration and alignment between the brushes, manufacturing of the system by component. Thereafter assembly of components may be accomplished without external fasteners, penetrations, glues, solvents, heat, or the like. Barbed extensions may snap into blind holes or cavities, with or without, but typically without having, and not requiring, access to an opposite side of the hole being fitted into by the barb.

Securement means fastening by any means available. Coupler is any material that is part of a connection between to pieces or regions, and is often a fastener independent from each. An apparatus in accordance with the invention may be sized for mascara application, but may also be large enough for hair coloring, hair coloring, hair straightening, other grooming functions, or the like.

Typically, solvents are involved with pastes and liquid products, so airtight reservoirs are used. Airtight means that evaporation of volatile constituents of the contained product in a closed container may be ignored as negligible over the term of use of the contents of the container. Evaporation whenever the container is in an open condition will continue, of course.

Directions are typically considered to be axial in a longitudinal direction, radial being orthogonal thereto, lateral or transverse being the same, but usually in a back-and-forth sense across the axial axis. A circumferential direction is centered on the axis. In general, rotation about an axial axis is as with aircraft directions, roll, with pitch being rotation orthogonal thereto (nominally up and down; vertical) and yaw being pivoting orthogonal to both of them (nominally in a horizontal plane).

A mortise is an opening in a member, such as an aperture in an arm of a device. A tenon is a member penetrating a mortise. Herein, any opening penetrated by a member is a mortise. The penetrating member is a tenon, as in construction, but not necessarily in a fixed relation as in construction.

A transverse direction is orthogonal to an axial direction. When Cartesian coordinates are used, one direction is axial, one transverse, and one lateral, all mutually orthogonal. In radial coordinates, any radial direction is transverse or lateral to the axial axis direction. Force and pressure are used in the common engineering or technical sense, pressure being force per unit of area supporting the force.

A brush is used by way of example, and is characterized by bristles. Any time a "brush" is described in this disclosure, it also stands for, represents, or may be thought of as a head, the distribution member of a device for applying (distributing) a material, usually applied to hair of some type.

For example, in certain embodiments of an apparatus and method in accordance with the invention the bristles may be replaced by teeth of a comb, sponges holding a wet or dry material to be applied, jaws or one half of a jaw or forceps formed by the two arms, or some other gripping mechanism. Even a mold, such as a rubber mold used in curling eyelashes may be placed at the ends of the arms or wands as a "head."

The concept of a biased-toward-closure applicator is that manipulation may be done without the need to apply a radial or lateral or transverse force (meaning any direction orthogonal to an axial or longitudinal direction) to keep the heads of the wands or arms together. Thus, the hand and fingers of a user are free to move in any direction suitable for applying a material to a subject. This freedom of motion facilitates the full range of motion of a hand of a user, constrained only by the object to be treated, whether eyelash, hair of the head, a group of selected strands, bangs, beard, or moustache. Likewise the material applied may be mascara, hair dressing, hair setting gel or liquid, moustache wax, hair color, or the like.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 18 is a front elevation view of one embodiment of an applicator portion of a system in accordance with the invention;

FIG. 19 is a left side elevation view of a guide aperture portion of one arm, penetrated by a guide pin from another arm, in an applicator;

FIG. 20 is a front, elevation, cross-sectional view of one embodiment of a guide pin passing through a guide aperture and grommet in a system in accordance with the invention FIG. 21 is a top end plan view of wipers for a base, supply, reservoir, or receptacle portion of a system in accordance with the invention, illustrating the sockets that may act as seals and the apertures whose edges act as wipers;

FIG. 22 is a front, elevation, cross-sectional view of one embodiment of an applicator (turned to horizontal) in accordance with the invention, illustrating a pressure-relieving actuator to push against an actuation pin doubling as a guide pin;

DETAILED DESCRIPTION OF THE INVENTION

Figure 1:
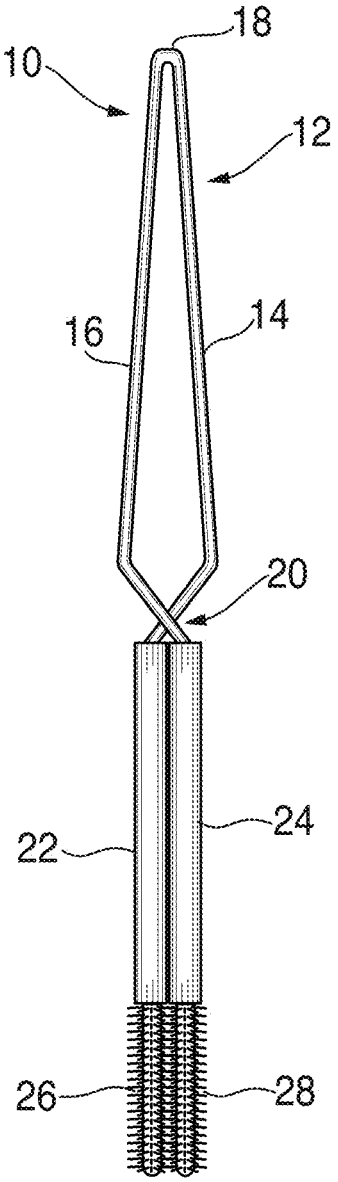
FIG. 1 is a front, elevation view of one embodiment of a dual brush eyelash applicator with reverse action in a closed position.
Figure 2:
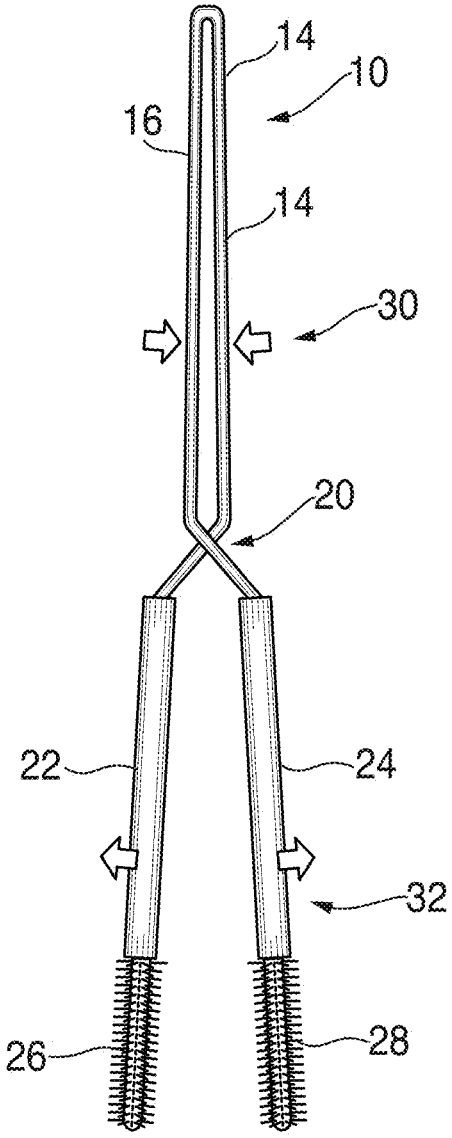
FIG. 2 is a front, elevation view thereof in an open position.

Referring to FIGS. 1 and 2, a simplified embodiment of an applicator 10 is shown, in which the reverse tweezers effect is easily seen. FIG. 1 shows a simplified embodiment of an applicator 10 having a reverse tweezers mechanism 12, consisting of arms 14 and 16 that are joined at an apex 18 at a proximal end, or handle portion 12, of the applicator 10. The arms 14 and 16 cross over at point 20, which may be located somewhat centrally along the length of the applicator 10. The portions of the arms 14 and 16 that are located on the distal side of point 20 are referred to as wands 22 and 24. Brushes 26 and 28 are attached to the distal ends of the wands 22 and 24, respectively.

The applicator 10 may be made of a flexible material that can bend when pressure is applied. Accordingly, when a pinching pressure 30 is applied to the handle portions of arms 14 and 16, they tend to move closer together, as shown in FIG. 2. Since the arms 14 and 16 cross over at point 20, that action of the arms has an opposite effect on the wands 22 and 24 and their brushes 26 and 28, causing the wands 22 and 24 and their respective brushes 26 and 28 to move away from each other, as shown by arrows 32.

Thus, the diameter of the handle portion 12 depresses and expands when pinching pressure 30 is applied, so that the user may spread the distal ends of the two wands 22 and 24 with attached brushes 26 and 28, and then close the wands 22 and 24 and their respective brushes 26 and 28 in order to have the brushes 26 and 28 surround or hug a user's lashes.

Figure 3:
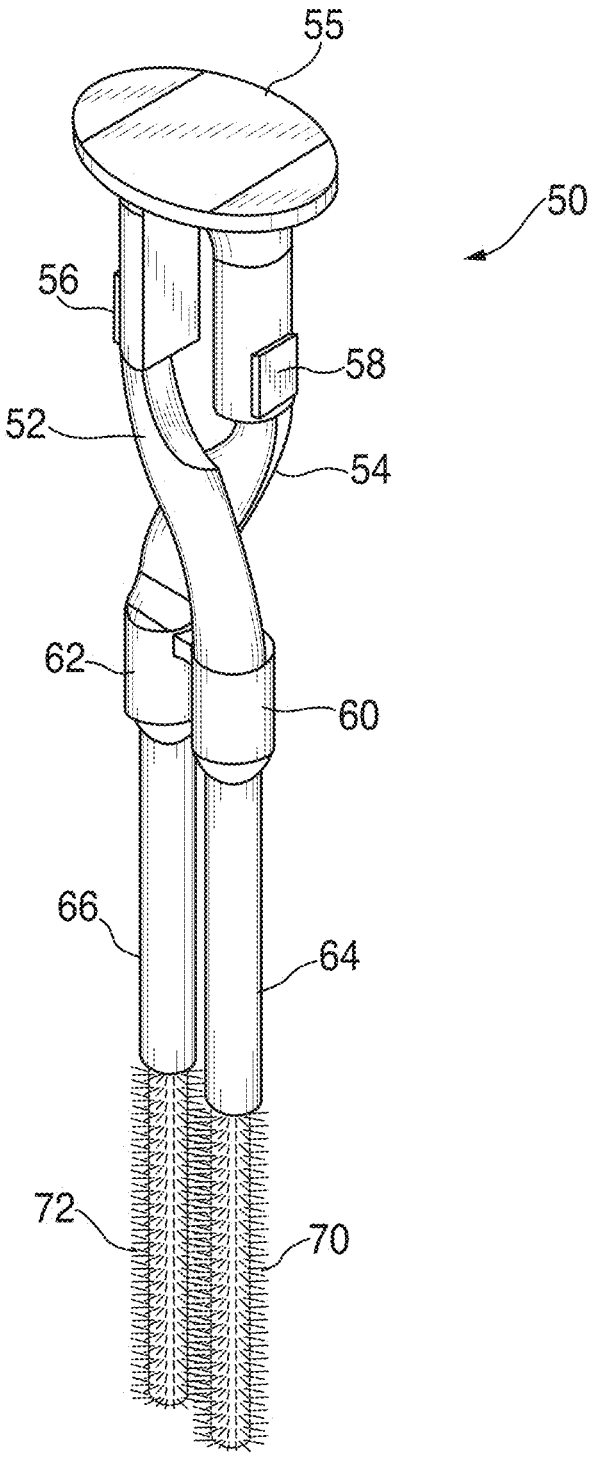
FIG. 3 is a perspective view of an alternative embodiment of an applicator in accordance with the invention.

Referring to FIG. 3, another embodiment of an applicator 50 is shown. That applicator 50 comprises a first arm 52 and a second arm 54 that cross over each other. The proximal ends of the arms 52 and 54 may be connected to oval tab 55 or they may be connected to each other in any other suitable manner to form a flexible hinge at the proximal end of the applicator 50.

A pressure point 56 may be located on a proximal part of arm 54 and a pressure point 58 may be located on a proximal part of arm 56. Distal ends 60 and 62 of the arms 52 and 54, which are located on a distal side of a location where the arms 52 and 54 cross over one another, may be connected to wands 64 and 66, respectively. Brushes 70 and 72 are respectively secured to the distal ends of the wands 64 and 66.

Figure 4:
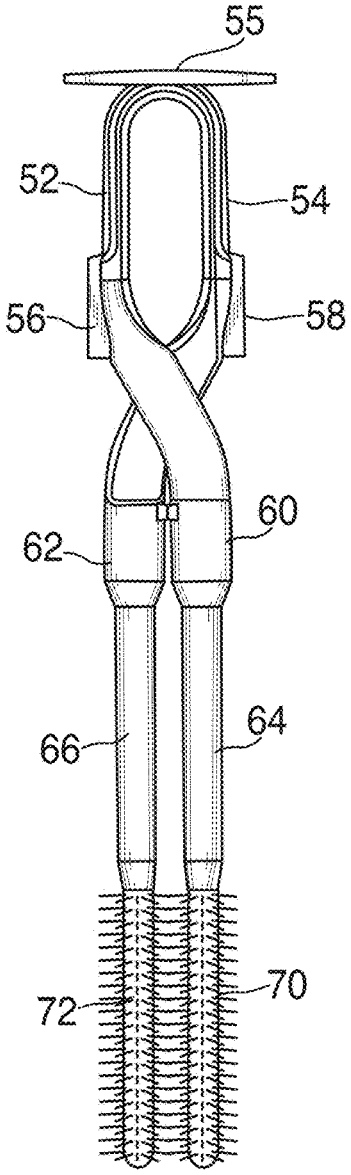
FIG. 4 is a front, elevation view thereof in a closed position.
Figure 5:
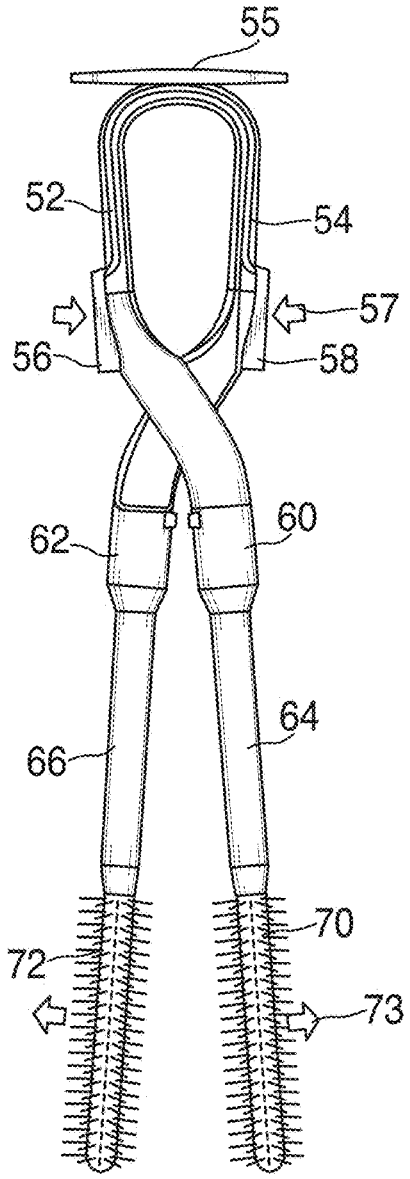
FIG. 5 is a front, elevation view thereof in an open position.
Figure 6:
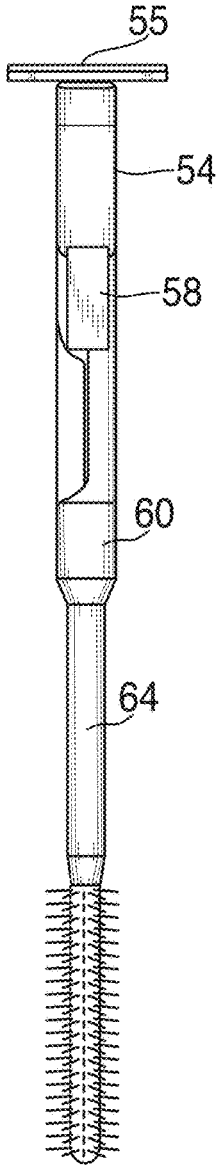
FIG. 6 is a right side, elevation view thereof.

Referring to FIGS. 4 through 6, this crossed-over structure of arms 52 and 54 creates a reverse tweezers mechanism. That is, as shown in FIG. 5, when transverse or pinching pressure 57 is applied by a user against pressure points 56 and 58, the distal ends 60 and 62 of the arms 52 and 54 tend to move in the opposite transverse direction, away from each other. Consequently, an outward force 73 causes the wands 64 and 66 and the brushes 70 and 72 to move away from each other. Conversely, as shown in FIG. 4, when the transverse or pinching pressure is released from the pressure points 56 and 58, the distal ends 60 and 62 of the arms 52 and 54 tend to move back together. Consequently, the wands 64 and 66 and the brushes 70 and 72 also move back together, to their original resting positions.

Figure 7:
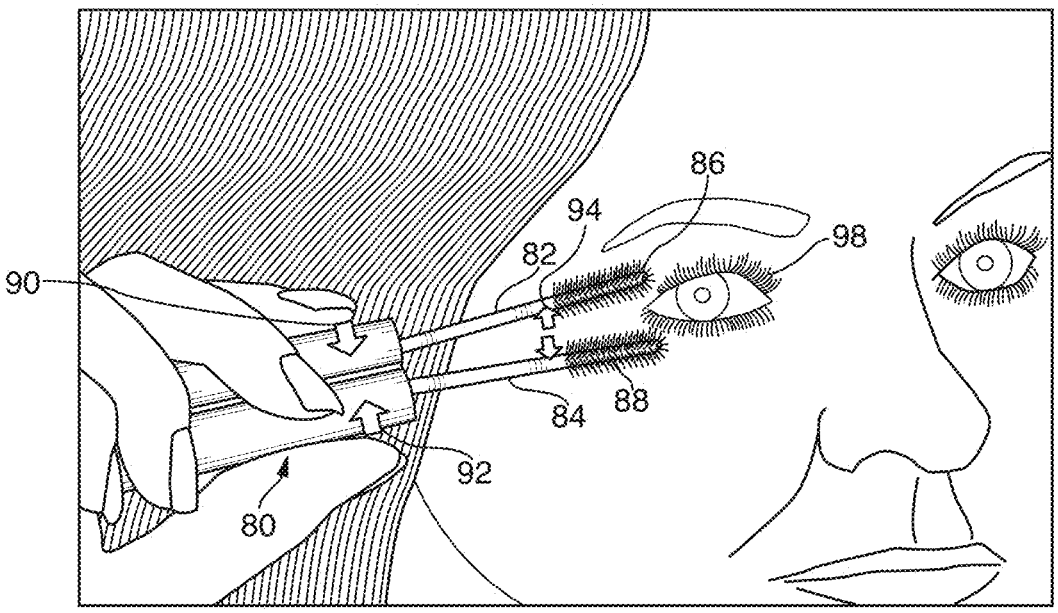
FIG. 7 is a perspective view thereof of an applicator in an open position in preparation to apply mascara in a method in accordance with the invention.
Figure 8:
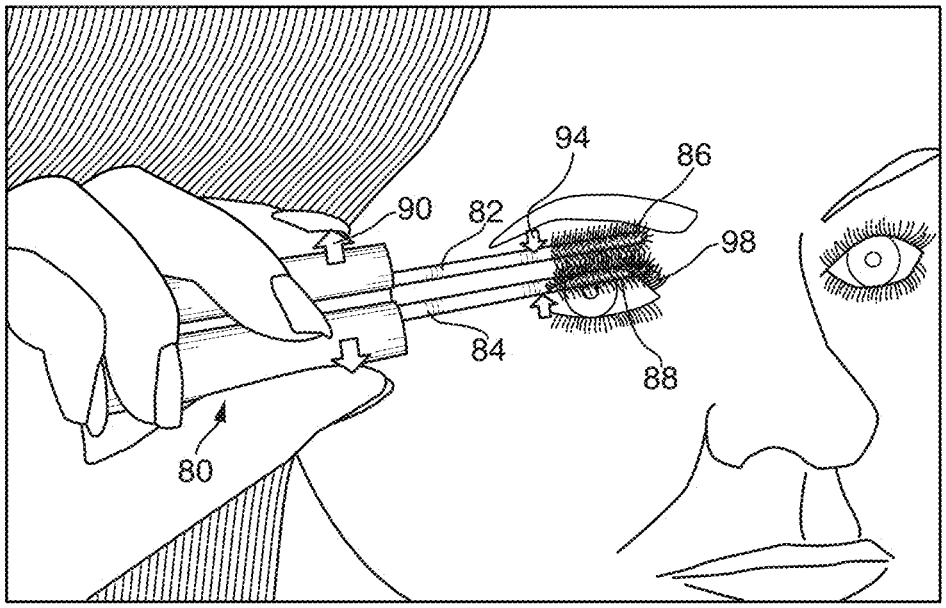
FIG. 8 is a perspective view thereof with the applicator in a closed position applying mascara to a lash.

Referring to FIGS. 7 and 8, an embodiment of a process for using an applicator to apply mascara is depicted. In FIG. 7, applicator container 80 is shown as containing a reverse tweezers mechanism of a handle portion of an applicator, to be discussed in more detail hereafter. A user pinches pressure points 90 and 92 on the applicator container 80, causing wands 82 and 84 to separate. Brushes 86 and 88 on the ends of wands 82 and 84, which are laden with mascara for application to the eyelash 98, also separate. A separation space 94 between the brushes 86 and 88 enables the user to place a set of her lashes 98 (e.g., lashes on an upper eyelid, lashes on a lower eyelid, etc.) between the brushes 86 and 88.

Figure 9:
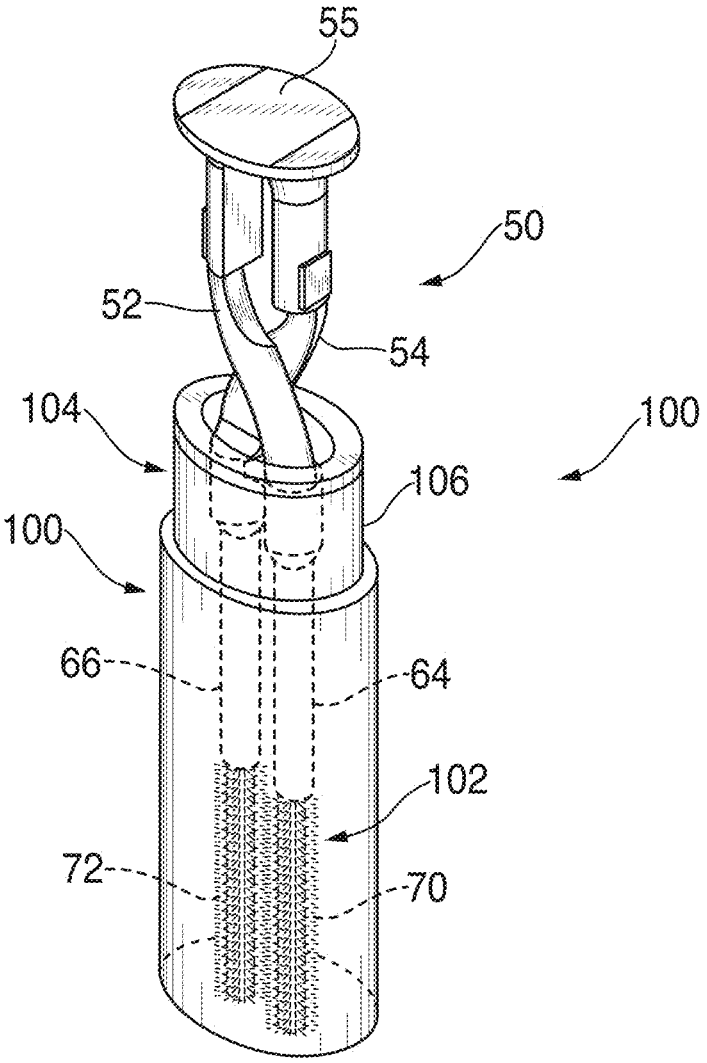
FIG. 9 is a perspective view of an applicator of FIG. 3 inserted into a reservoir of a container in accordance with the invention.

Referring to FIG. 9 shows the user releasing pressure from the pressure points 90 and 92, thereby causing the wands 82 and 84 to move towards each other and the separation space 94 to diminish. The brushes 86 and 88 come together on the top side and the bottom side, respectively, of the lashes 98. The user draws container applicator 80 away and up from the lashes 98, causing the brushes 86 and 88 to deposit and distribute the mascara over the lashes 98 as the brushes 86 and 88 are pulled in a forward direction across and off of the lashes 98.

The dual brushes working together in tandem with each other may achieve multiple functionality of providing a desired volume, a desired length and a desired amount of eyelash separation. A thicker circumference brush holds more mascara within its bristles so it achieves a more voluminous look. A thinner circumference brush with multiple bristles achieves a longer looking lash. And a thinner circumference brush with thinner, more separated bristles achieves lash separation. In the present embodiment, the upper brush 86 may have a thicker circumference to focus on applying mascara in a manner that makes the lashes 98 appear to be thicker. The lower brush 88 may have a thinner circumference to apply mascara in a manner that makes the lashes 98 appear to be longer. However, any combination of brushes may be used to achieve a desired appearance.

Referring to FIG. 9, a mascara container 100 is shown. A mascara receptacle 102 is located at the bottom of the mascara container 100. A top portion 104 of the container may include a wall 106 with a smaller outer dimension than the corresponding outer dimension of the wall of the receptacle 102, with a ledge defining a boundary between the outer surfaces of the receptacle 102 and the outer surfaces of the wall 106. This difference in dimensions may accommodate an end of an applicator container (not shown in FIG. 9) or otherwise facilitate coupling of an applicator container to the mascara container 100.

The applicator 50 may be placed in the mascara container 100, so that the wands 64 and 66 and their respective brushes 70 and 72 extend into the mascara receptacle 102 for storage and/or to receive the mascara therein. The mascara container 100 may have a dual-squeegee portal (not shown in FIG. 9) to accommodate the two wands 64 and 66 and brushes 70 and 72 of the applicator 50.

The user may apply slight pressure to the arms 52 and 54 of the applicator 50 the wands 64 and 66 enough to enable them to align with and to be inserted into their respective portal (not shown in FIG. 9) of the receptacle 102 of the mascara container 100. Once the brushes 70 and 72 are in place within their respective portals, they may gather mascara within the receptacle 102.

Excess mascara may be squeegeed off of the brushes 70 and 72 as they are pulled out of the portals. The mascara receptacle 102 may also be a holding chamber where the brushes 70 and 72 reside, or are stored, until the next usage. The mascara receptacle 102 may have either a single chamber for receiving both brushes 70 and 72 or two separate chambers, each corresponding to a single portal and being configured to receive a single brush 70, 72.

Figure 10:
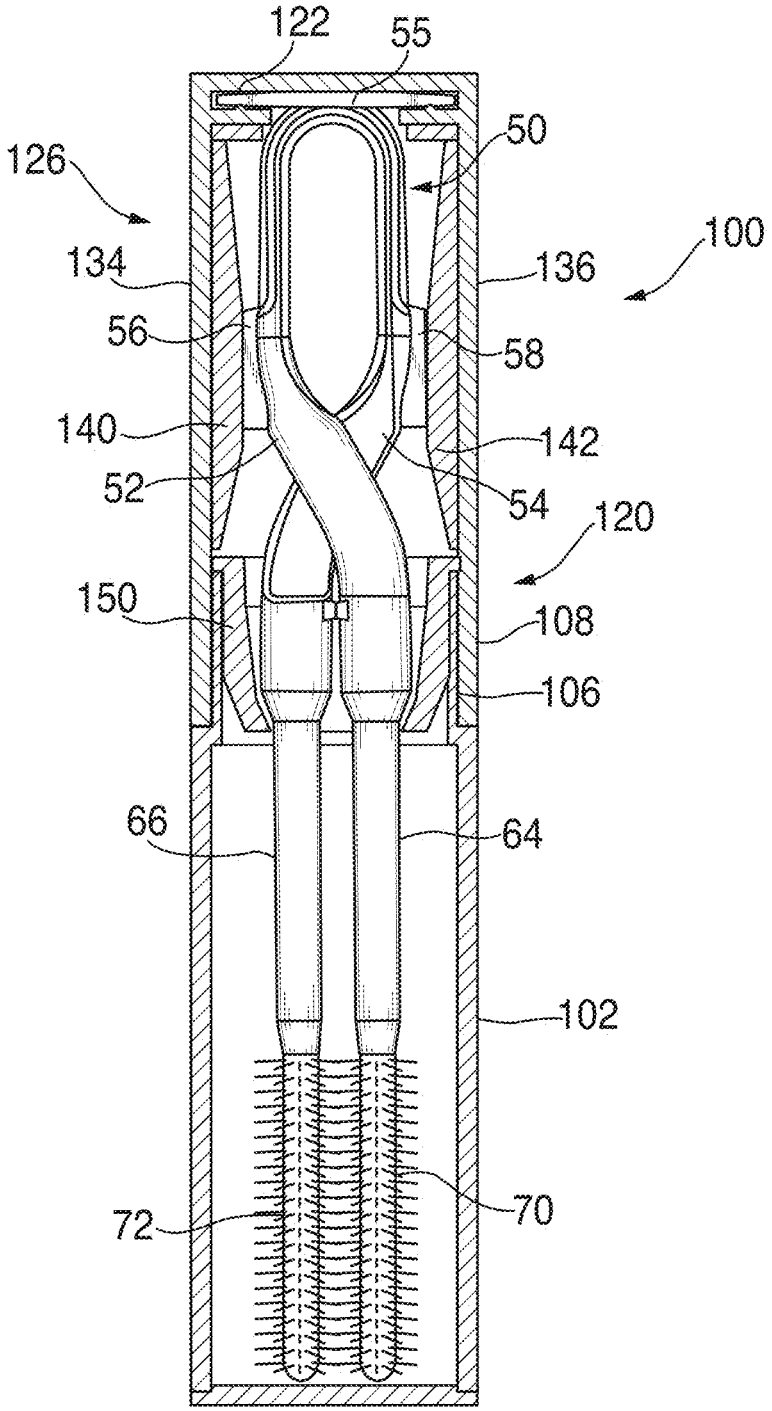
FIG. 10 is a front, elevation view of the applicator of FIG. 9 located within both the reservoir and cap of the container shown in front, elevation, cross-sectional view.

Referring to FIG. 10, the mascara container 100 holds the applicator 50 therein. The mascara container 100 is configured to be coupled with an applicator container 120. The applicator container 120 houses the upper, or proximal, part of the applicator 50, including the proximal ends of the arms 52 and 54 and any pressure points 56 and 58 thereof. A lower portion 108 of the applicator container 120 is sized to fit snugly over and/or around the wall 106 of the top portion 104 of the mascara container 100 so that the applicator container 120 and the mascara container 100 may fit snugly together and releasably couple to one another.

The space 122 (cavity 122) in the handle portion 126 (top 126, or cap 126) receives the tab 55. The walls 134, 136 may be movable or flexible to support motion needed to apply (transmit) finger pressure to the pressure points 56, 58 acting to separate the brushes 70, 72.

Figure 11:
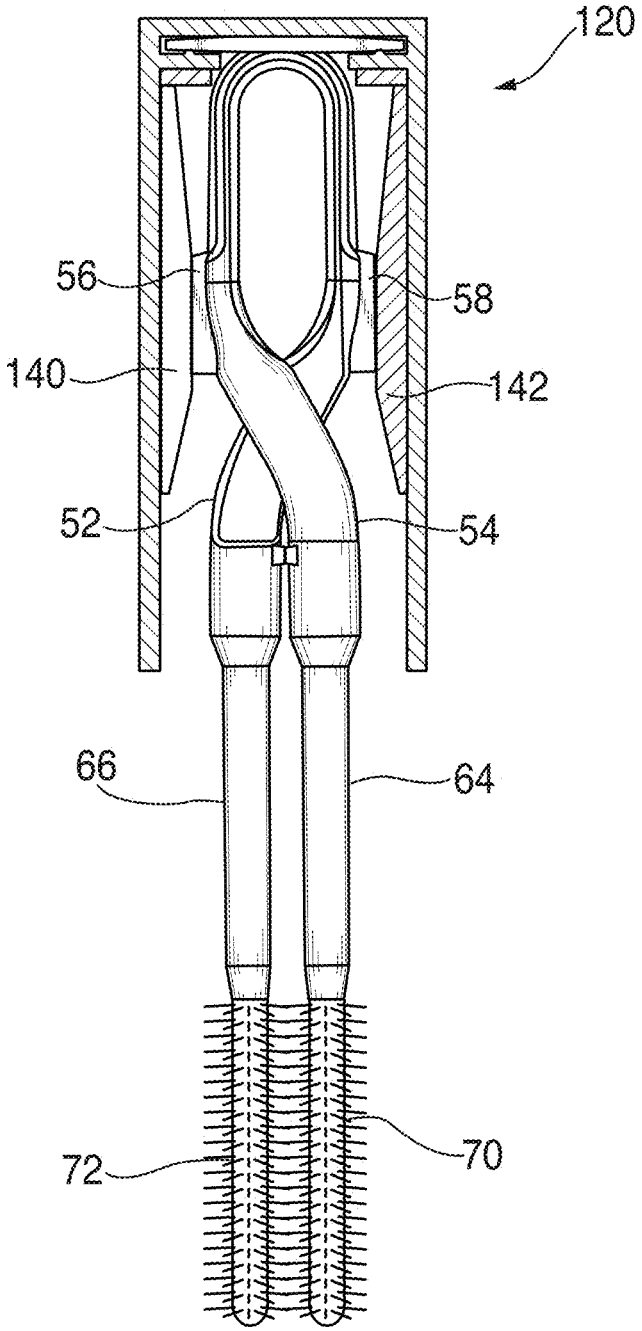
FIG. 11 is a front, elevation view of the applicator of FIG. 9, assembled within the cap shown in a front, elevation, cross-sectional view of the container.

Referring to FIG. 11, the applicator container 120 is shown separated from the mascara container 102 (FIGS. 9 and 10), with the proximal portion of the applicator 50 in the applicator container. The applicator container 120 may include protrusions 140 and 142 (e.g., convex members, etc.) on an inside surface of the applicator container 120. The protrusions 140 and 142 may be configured to engage corresponding pressure pads 56 and 58 of the applicator 50.

For example, the protrusions 140 and 142 may be in close proximity, in contact with, etc., the pressure pads 56 and 58. The applicator container 120 may be configured in such a way that, when a transverse force is applied to appropriate opposite locations on the outer surface of the applicator container 120, force may be transmitted to the handle portions of the arms 52 and 54 (e.g., via convex members 140 and 142 to pressure tabs 56 and 58, etc.). This action will cause the arms 52 and 54 to move closer together the brushes 70, 72 farther apart.

By means of the reverse tweezer structure discussed above, the wands 64 and 66 move apart from one another, causing the brushes 70 and 72 to separate, as shown in FIG. 8. Thus, the brushes 70 and 72 may be positioned above and beneath a user's lashes 98, then closed by releasing pressure (force).

Figure 12:
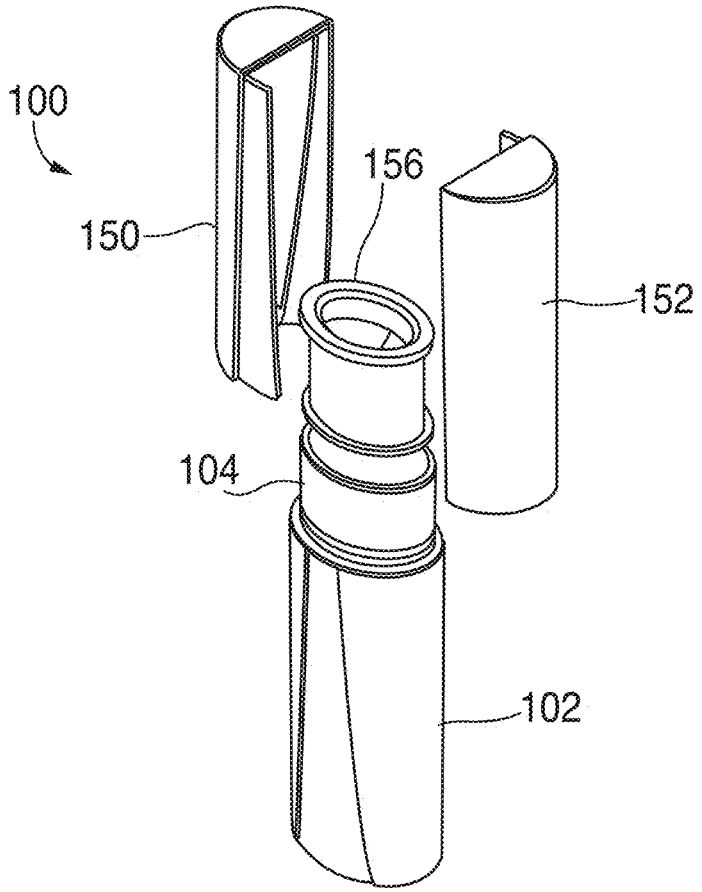
FIG. 12 is an exploded, perspective view of one embodiment of a container for housing an applicator, and represents one embodiment of the container illustrated in FIGS. 9, 10, and 11.

Referring to FIG. 12, an exploded view of an embodiment of the applicator container 120 includes two members 150 and 152 (e.g., substantially semi-cylindrical members, as shown in FIG. 12, etc.) that may be associated with one another in a manner that enables them to move relative to each other. This movement imparts the applicator container 120 with flexibility, making it possible to squeeze the members 150 and 152 and, thus, the arms 52 and 54 together. This action results in the reverse tweezer action of the applicator 50, causing the wands 64 and 66 and, thus, the brushes 70 and 72 to separate.

Figure 13:
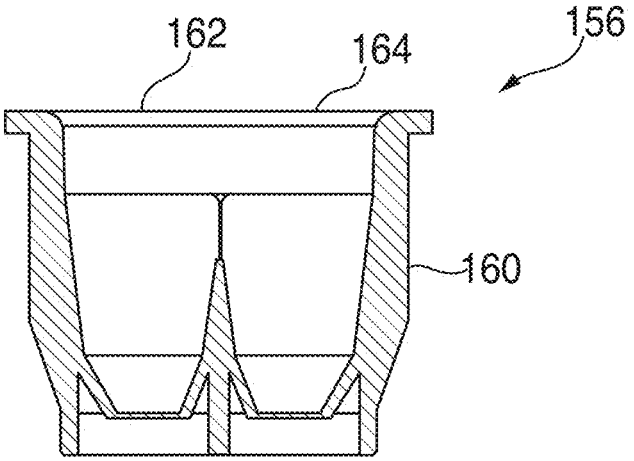
FIG. 13 is a front, elevation, cross-sectional view of the squeegee or wiper mechanism of FIGS. 9, 10, and 11, suitable for receiving the wands of an applicator.

Referring to FIG. 12, a tool 156 at the top of the mascara container 100, above the receptacle 102, removes excess mascara from the brushes 70 and 72 as the brushes are pulled from receptacle 102. This tool 156 may include a pair of squeegees, one at or near the top of a port through which each brush 70, 72 enters and exits the receptacle 102. Alternately, as shown in FIG. 13, the tool 156 may be a squeegee 160 comprising a flexible, resilient material that defines the ports 162 and 164 through which the brushes 70 and 72 enter and exit the receptacle 102. Other mechanisms may alternately be used to remove excess mascara from the brushes.

Figure 14:
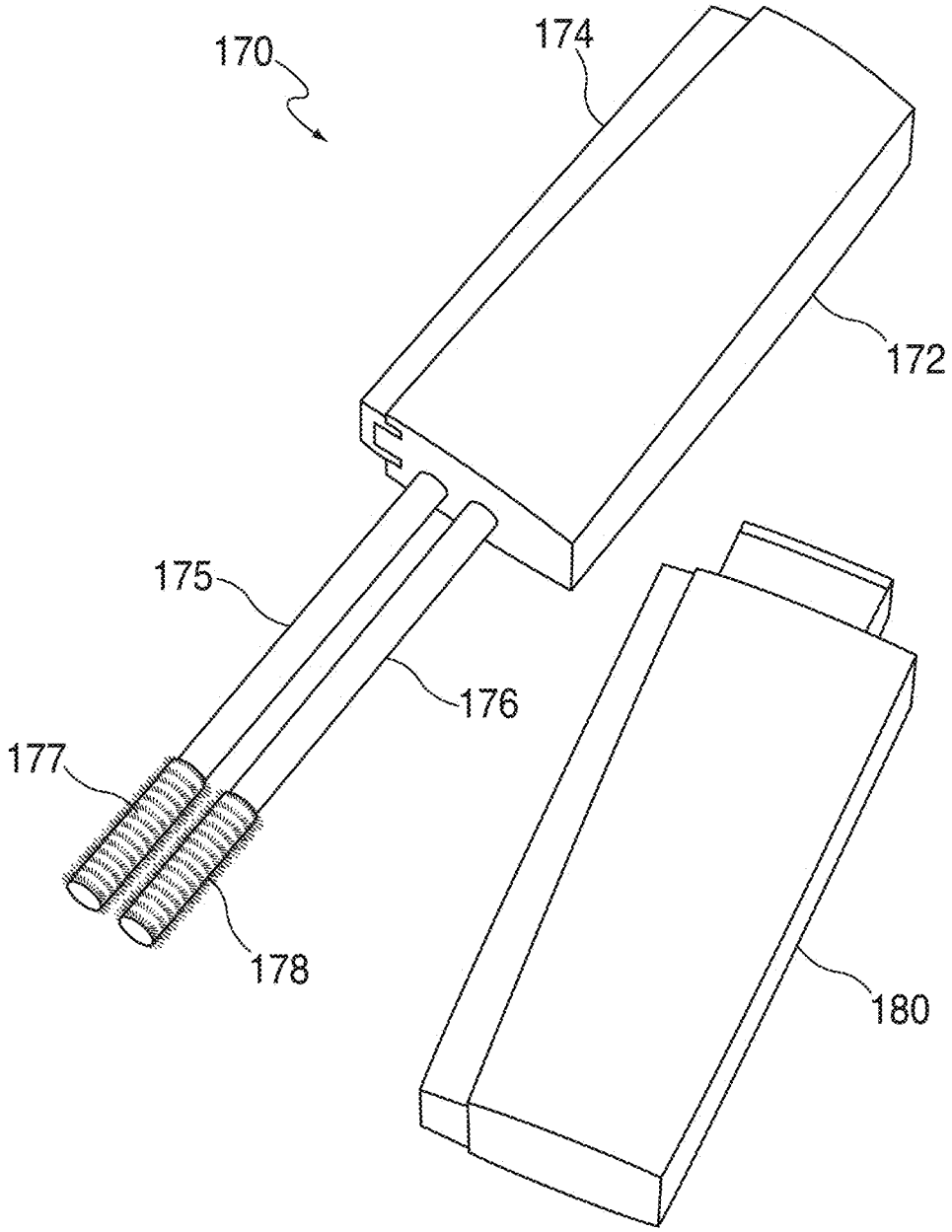
FIG. 14 is a perspective view of an alternative embodiment of an applicator and case (container), with the case open.

Referring to FIG. 14, another embodiment includes a container 170 with an applicator, similar to the applicator shown in FIGS. 1 through 3. In this embodiment, the applicator container 172 has an actuator 174 constructed as a strip along on one side. Applying pressure to the actuator 174 actuates the reverse tweezer mechanism of the handle portion of the applicator within the applicator container 172, causing the wands 175 and 176 and their respective brushes 177 and 178 to move away from each other in a reverse tweezer action, such as that described above. The container 170 also includes a mascara container 180, constructed similarly to the mascara container shown in and described with reference to FIGS. 9 and 10. It has a chamber for mascara, dual ports for accepting the wands 175 and 176 and the brushes 177 and 178 and one or more squeegees (not shown). Actually, constricting bristles will force (extrude) mascara from between them and off the brushes, even without flexible squeegees. Elastomeric apertures make a better seal and relax tolerances of fit.

Figure 15:
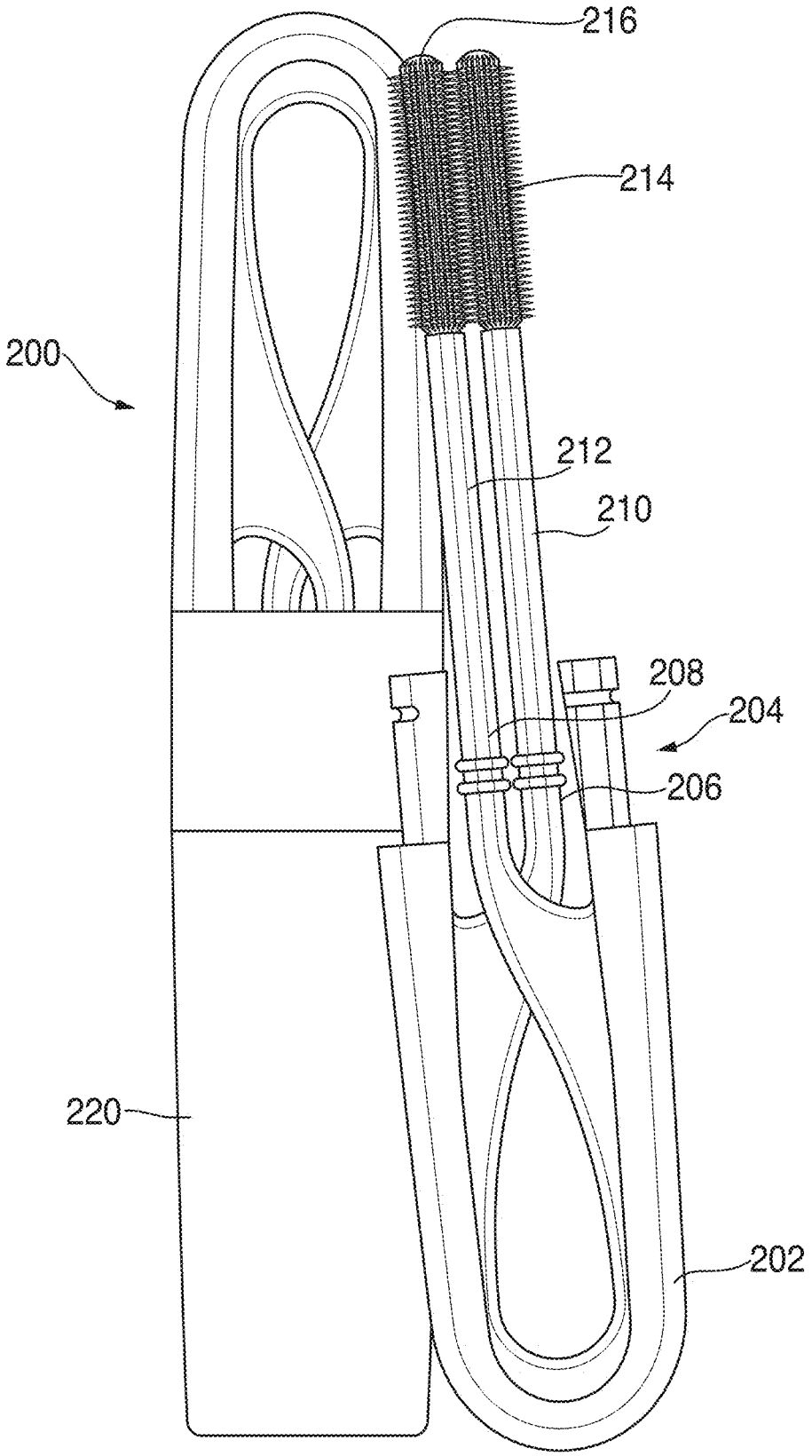
FIG. 15 is a front, elevation view of an alternative embodiment of an applicator, in front of a second applicator in a reservoir in a container.

Referring to FIG. 15, this embodiment of a container 200 with an applicator, is also similar to the mascara application systems shown in FIGS. 1 through 3. The applicator container 202 includes open sides, which reveal the handle portions of an applicator 204. The applicator 204 includes arms 206 and 208 that cross over one another, and that correspond to wands 210 and 212, which carry brushes 214 and 216. Applying pressure to appropriate locations on opposite sides of the applicator container 202 actuates the reverse tweezers mechanism, causing the wands 210 and 212 and their corresponding brushes 214 and 216 to move away from each other. The mascara container 220 is constructed similar to the mascara container shown in and described with reference to FIGS. 9 and 10, with a chamber for mascara, dual ports for accepting the wands and brushes and one or more squeegees (not shown).

From the foregoing description it can be seen that the arrangement of the dual brushes may decrease the amount of time required to apply mascara, as brushes coat the upper and under sides of the user's top lash at the same time. In some embodiments, the interplay of the dual brushes working together in tandem may simultaneously add volume, lengthen lashes and separate lashes depending on the types of brushes used, a combination of eyelash appearances may result.

A thicker circumference brush holds more mascara within its bristles so it achieves a more voluminous look. A thinner circumference brush with multiple bristles achieves a longer looking lash, and a thinner circumference brush with thinner, more separated bristles achieves lash separation. The brushes may be curved or straight, full or minimal, short or long, bristles or silicone. Some combinations of brushes may achieve various looks not easily achieved with a single mascara brush. Examples of dual brush combinations include: (a) a full top brush and a skinny bottom brush, either curved or straight to achieve volume and fullness on the top and to separate and lengthen from the bottom; (b) a full top brush and a full bottom brush, both with short lengths to achieve maximum volume and fullness; (c) top and bottom brushes formed from medium silicone and having a medium length to achieve added length and separation; and (d) top and/or bottom brushes that are sculpted to nest with each other to achieve precision and definition.

The reverse tweezers mechanism facilitates improved user control when applying mascara. Unlike other previous mascara applicators, a steady pressure is automatically applied by the flexible reverse tweezers mechanism, which forces the brushes toward one another in a manner that surrounds and hugs the lashes. Manual pressure is needed only to position the brushes above and beneath the lashes and, in some embodiments, to position the brushes in the mascara container. This action may make the process of applying mascara more spontaneous, manageable, fluid, comfortable, ergonomic and/or efficient.

The applicator may be associated with an applicator container that at least partially encases a proximal, handle portion of the applicator in a manner that enables actuation of the reverse tweezers mechanism. This arrangement may enable the user to apply pressure to one or both sides of the container to move the brushes apart from one another and to release the pressure so that the brushes move back together in a nestled position. In addition, the applicator container may impart the applicator, as well as an assembly of the applicator, the applicator container and the mascara container, with a sleek look.

The mascara container may be configured to hold mascara and the brushes of the applicator. The mascara container may have dual portals through which the two brushes may be brought into contact with the mascara, and two squeegees to remove excess mascara from the brushes and return it to one or more receptacles that contain the mascara. The two portals may also provide a clean and efficient way to hold and store the dual brushes after mascara application has been completed. The dual squeegees may also help to seal the receptacle from exposure to the atmosphere and, thus, prevent drying of the mascara.

Referring to FIGS. 16 through 44, while continuing to refer generally to FIGS. 1 through 44, a system 230 in accordance with the invention may include an applicator 228. The applicator 228 may be any of the embodiments described hereinabove, such as the applicator 10, 50, 120, 202, or the like. The applicator 10 may fit within a container 232. The container 232 may be any of the containers illustrated herein, including, for example, the containers 80, 100, 170, 180, 200. In the illustrated embodiment, the container 232 may be made up of a cap 234 or cap portion 234. The cap 234 may operate as a handle 234 as well as a cap 234 with respect to a base 236. The base 236 may be thought of a receptacle 236 or a reservoir 236 for a product, such as mascara. In the illustrated embodiment, the cap 234 may correspond to the top portion 126 or applicator container 80, 202, or the like. Meanwhile, the base 236 may correspond to the receptacle 102, 180, 220, or the like.

Herein, a reference numeral may refer to any component of a particular type. A trailing letter following a reference numeral indicates a specific instance of an item of the type identified by the reference numeral. Thus, a statement regarding an item identified by reference numeral only may refer to any or all items of that type. A statement referring to an item identified by reference numeral and trailing letter relates to the specific instances identified by that reference numeral with that trailing letter.

Brushes 238 may be identified as a fixed brush 238*a* or a comparatively immovable or less movable brush 238*a*, and a more readily movable brush 238*b*. In the illustrated embodiments, the brushes 238 need not be the same size. In general, the brushes 238 may correspond to the brushes 26, 28, 70, 72, 86, 88, 177, 178, 214, 216. In general, mascara brushes 238 are themselves an art and a science. Various embodiments exist, including various embodiments described herein. In general, the bristles may be formed for specialty purposes. Similarly, the comparative diameters of the brushes 238 in pairs may be modified. As illustrated, the shapes of the brushes 238 may be different in pairs in accordance with the invention.

In an applicator 228 in accordance with the invention, arms 240 may extend from a vertex 18 at which the arms 240 connect. A fixture 241 may be used to secure the arms 240 into the cap 120 (also called a handle 120 or handle portion 120 of the container 100. The vertex 18 also referred to sometimes as an apex 18 represents a fixed connection, whether assembled, homogenously formed, molded, or otherwise connected between the two arms 240. The vertex 18 will typically represent or enact as a fixed anchor 18 against which the individual arms 240 may flex between their proximal ends near the vertex 18, and their distal ends proximate the brushes 238.

The arms 240 may extend to wands, such as the wands 22, 24, 64, 66, 82, 84, 175, 176, 210, 212. On the other hand, the arms 240 may include both an arm portion and a wand portion as a single homogenous component. In other embodiments, wands and arms may be separately formed and assembled. For example, hereinabove certain embodiments include an arm 14, 16, 52, 54, 206, 208, and the like. Arms 240 include both any functionality by arms and wands. One reason for this is that it is currently contemplated that the arms 240 will be manufactured in the most efficient manner available. Accordingly, the arms 240 may be manufactured by homogenously forming in a metal press, metal molding process, polymeric (plastic) molding process, or the like. In some embodiments, both arms 240 may be fabricated together at the same time or molded at the same time as a unit. In other embodiments, illustrated herein, the arms 240 may be assembled.

In certain embodiments, a system 230 in accordance with the invention may include an actuator 242. The actuator 242 may be a mechanism 242 for separating the arms 240 from one another, thus moving them away from one another in the equilibrium or rest position to extend them apart in an extended or open position. The rest position is a position in which the brushes 238 are together, the bristles even interleaving to a certain extent, with the lash 98 of a user captured therebetween and receiving makeup (e.g., mascara) from the bristles of the brushes 238 onto the lashes 98. In the illustrated embodiment, the arms 240 are separated by a guide 244 or pin 244. The guide 244 or pin 244 may also be referred to as a guide pin 244. The pin 244 operates to perform several functions simultaneously. For example, the guide pin 244 may be rigidly secured to or homogenously formed with the more flexible arm 240*b*. Meanwhile, an aperture 246 in the comparatively immobile or stiffer arm 240*a* operates to receive the pin 244 therethrough. Thus, the pin 244 stabilizes the flexible arm 240*b* with respect to the comparatively less flexible arm 240*a* in order to assure constant alignment of the brushes 238 with each other in all positions. The guide pin 244 may pass through an aperture 246 in a comparatively stiffer arm 240*a*, as well as a second aperture 247 in the container 232. For example, the pin 244 passes through the aperture 246 in the comparatively stiffer arm 240*a* stabilizing the comparatively more flexible arm 240*b* with respect to the stiffer arm 240*a*. At the same time, the pin 244 may pass through the cap 234 by way of an aperture 247. Thus, the pin 244 is presented as an extension outside the cap 234. In that location, the pin 244 may be depressed to spread the arms 240 apart, and consequently the brushes 238 apart.

Nevertheless, the pin 244 needs to have a comparatively small diameter or effective diameter. An effective diameter is four times an area divided by the wetted perimeter, and is a common engineering term in fluid mechanics. The expression is sometimes used as "effective diameter." For example, the pin 244 may have a circular cross section, a rectangle cross section, a hexagonal or other polygonal cross section, or the like. Thus, the pin 244 may have an effective diameter, regardless of its cross-sectional shape or area. Nevertheless, competing functionalities militate for various configurations. For example, in order to pass through the comparatively stiffer arm 240*a*, the pin 244 may need to be smaller than desired. In order to maintain its strength and stiffness, the pin 244 may need to be a larger effective diameter than desired. Meanwhile, passing through the cap 234, the pin 244 may present a comparatively small area, requiring substantial pressure on a finger of a user trying to activate the applicator 10 by pressing on the pin 244. Pressure is an engineering term defined as a force per unit of cross-sectional area supporting that force. Thus, stress is in pounds per square inch. Force is in pounds per square inch or force per unit of area. Thus, the force that may be applied by a thumb of a user may easily be accommodated with a comparatively large area, thus a reduced pressure. In contrast, the same amount of force on a considerably smaller area may cause discomfort. Ultimately, force applied to a thumb of a user or fingertip in which the cross-sectional area of the pin 244 were reduced to a sharp point, would cause pain due to pressure.

In order to reduce the pressure required for a user to operate the pin 244, the system 230 may include an actuator 242 that operates as a pressure plate 242. For example, the actuator 242 may connect to the cap 234 that operates as a handle 234 and a cover 234 in such a way as to flex easily or deflect easily under pressure from the hand of a user. Meanwhile, formed of a suitably stiff and hard plastic or elastomeric polymer, or the like, the actuator 242 may also operate to be comparatively hard and stiff with respect to the pin 244. Thus, the user or operator may press on the actuator 242, and the actuator 242 takes the pressure of the pin 244 and distributes its effective force or resultant force over a much broader area. In certain embodiments, the actuator 242 may actually fit into a tray 248 or relief 248 formed in the cap 234 of the container 232.

The cap 234 may be secured to the base 236 or reservoir 236 by any of several mechanisms. For example, a twisting bayonet-type latch, or rotating latch is one alternative embodiment. Similarly, a sleeve 250 or collar 250, such as a union fitting in a plumbing system may be used to connect a cap 234 to a base 236 without rotating either with respect to each other. A shoulder or the like may hold the collar 250 fixed in a longitudinal direction with respect to the cap 234, while leaving the collar 250 completely free to rotate with respect to the cap 234. Thus, the collar 250 may be rotated with respect to the cap 234, and with respect to the base 236 thus engaging threads 252*a* on the collar with threads 252*b* on the base 236.

The base 236 may include a closure 254 having wipers 256 or edges 256 about apertures 258. The apertures 258 may be sized to receive the arms 240, but deflect the brushes 238. Thus, excess product from the reservoir portion 236 will be wiped from the bristles of brushes 238 as they pass back out of the reservoir portion 236 for use. The apertures 258 may be of the same size, or may be of different sizes.

Meanwhile, the closure may have shoulders, walls, and other fittings to fit snuggly and air tight within a top opening of the base 236. Typically, an effective closure 254 may be made of an elastomeric material that is readily flexible. For example, a coefficient of elasticity may be engineered for the closure 254 such that it will readily secure itself within the base 236, while also fitting sockets 260 or seal faces 260 against a stopper 262 or seal 262 formed on each of the arms 240.

Figure 16:
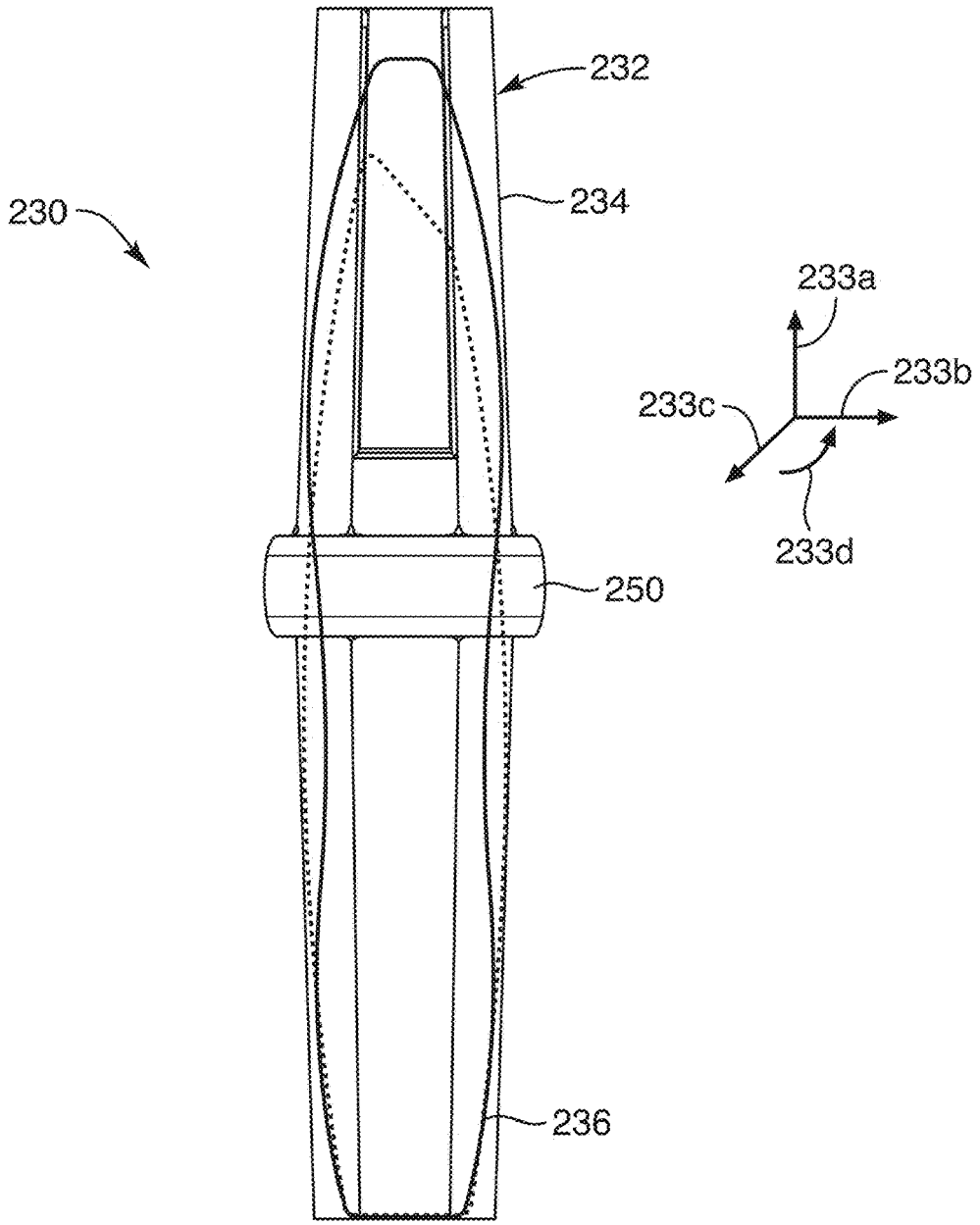
FIG. 16 is a right side elevation view of one closed alternate embodiment of a system in accordance with the invention, superimposed with the spatial profiles of example cosmetics cases for comparison, illustrating the size and outer envelope.
Figure 17:
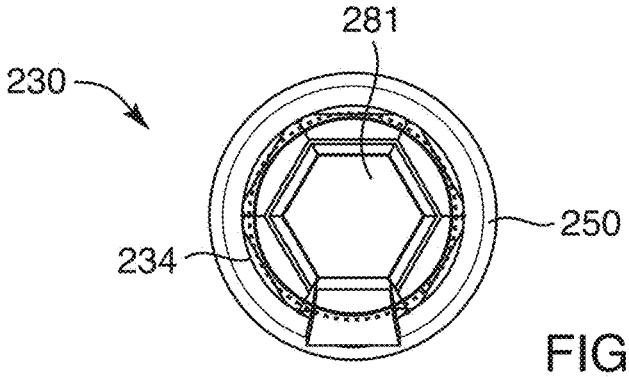
FIG. 17 is a top end plan view thereof.

Referring to FIG. 16, system 230 may comprise a container 232 or case 232 formed of a cap 234 and a base 236. These may be connected by a collar 250 that rotates with respect to each, being secured by a keeper or sleeve, such as a rim, lip, or the like that fits on a matching shoulder in the cap 234 in order to be freely rotating, but longitudinally constrained in a longitudinal direction 233*a* but free to rotate in a circumferential direction 233*d*. Of course, the horizontal directions laterally 233*b* and transversely 233*c* are constrained, by the cap 234. Once rotating sufficiently, the collar 250 may securely snug the cap 234 and base 236 together.

Referring to FIG. 16, the cross-sectional shape and area of the system 230 may be in any selected shape. The instant embodiment is illustrated as hexagonal, at least in the interior shape of an end cover 234 or cap 234.

Referring to FIG. 18, a front, elevation, cross-sectional view illustrates the relationship between the container 232, shown mostly cut away, and the applicator 10. In this embodiment, barbs 264 are used as securement mechanisms 264. In general, barbs 264 may operate as one-way mechanisms to pass through an aperture, being compressed, depressed, or otherwise deflected to pass through an aperture, then returning to latch into an equilibrium position, but returning to that equilibrium position once having passed through a particular aperture. Thus, the barbs 264 will be matched to apertures 266. Here, barbs 264*a* and 264*b* are illustrated. The barbs 264*a* pass through an aperture 266*a* thus securing the comparatively more flexible arm 240*b* to the less flexible arm 240*a* at or near the vertex 18 at which they join. Meanwhile, a fitting 268 is provided to fit into the cap 234 of the container 232.

One will note that the brushes 238*a*, 238*b* are not of the same size. This may be by design in order to accomplish multiple functions, and complementary functions between the two brushes 238*a* and 238*b*.

Meanwhile, the alternative embodiments of the pin 244 in two different locations illustrate a design option. For example, at the higher position identified by a letter A, the pin 244 requires less motion, but requires more force, having less leverage on the comparatively more flexible arm 240*b*. In the position identified by the letter B, the pin 244 would be able to have a greater leverage advantage, thus requiring less force to move the arm 240*b* away from the arm 240*a*. Similarly, the collar 250 is illustrated with a shoulder 269*a* seated against a corresponding shoulder 269*b* on the cap 234. Detents, and other capture mechanisms may be used to keep the shoulder 269*a* positioned proximate the shoulder 269*b* without moving away therefrom along the longitudinal direction 233*a* of the cap 234.

One also sees how the stoppers 262 secured air tight or formed with the arms 240 fit inside respective sockets 260 in order to form a seal between the socket 260 and the stopper 262.

Referring to FIG. 19, an aperture 246 is shown in the arm 240*a* in one embodiment, wherein the arm 240*a* may be an I-beam shape, or a channel shape. Thus, the flanges 271*a* and the web 271*b* may form an H or I shape in the cross section of the arm 240*a*. The aperture 246 is formed therein to receive the pin 244 passing therethrough to stabilize the arms 240 with respect to one another, and provide access by the pin 244 to a position outside the case 232 or container 232, and specifically outside the cap 234.

Referring to FIG. 20, the aperture 246 in the arm 240*a* may have a corresponding aperture 247 in the cap 234 in order to pass the pin 244 through the cap 234. A grommet 270 therein may provide a seal, or simply reduce tolerances in order to provide a smoother motion of the pin 244 through the cap 234. Likewise, manufacturing tolerances may be relieved by having an elastomeric material for the grommet 270, thus permitting a larger diameter and a more gross tolerance in the aperture 247.

Referring to FIG. 21, the closure 254 may be formed of an elastomeric material to provide a socket 260 for each of the arms 240*a*, 240*b*, and their respective brushes 238*a*, 238*b* to pass through. Thus, apertures 258 therein are surrounded by edges 256 and effectively act as wipers 256 bending the bristles of the brushes 238 in order to remove excess product and more evenly coat the bristles of the brushes 238.

Referring to FIG. 22, the actuator 242 is illustrated in one embodiment, wherein the cap 234 contains the applicator 10, and the pin 244 is driven by the actuator 242 to separate the arms 240*a*, 240*b* from each other. Of course, the arms 240 separate from one another in order to separate the brushes 238*a*, 238*b* from one another. A force 272 applied by a finger 274 of a user against the actuator 242 need not apply. A apply to a user's finger an uncomfortably large pressure, since the actuator 242 distributes load from the finger 274, and applies the necessary force to the pin 244.

Figure 23:
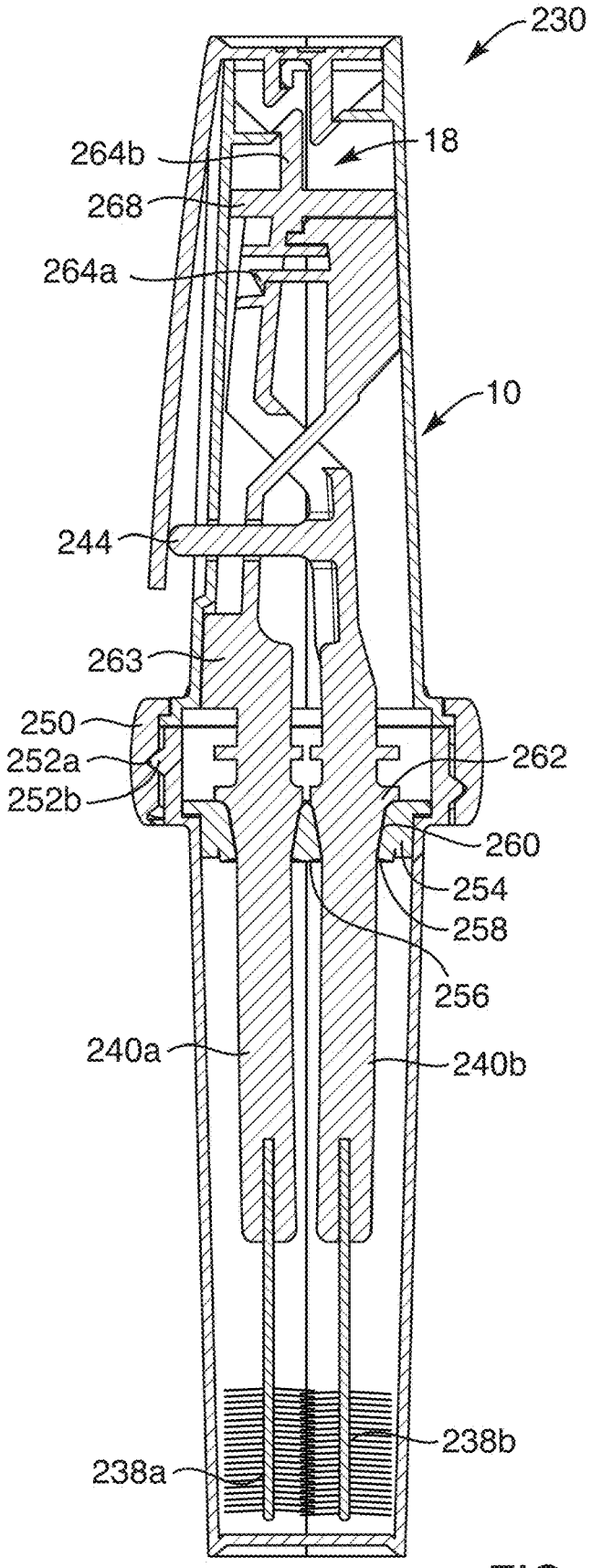
FIG. 23 is a right side, elevation, cross-sectional view of an alternative embodiment of an applicator system in accordance with the invention.

Referring to FIG. 23, as described in detail hereinabove, the arms 240 may cross. In this configuration, a pin 244 may be used to maintain alignment or registration to stabilize the arms 240*a* and 240*b* with respect to each other. Alternatively, the arm 240*a* may pass through a slot formed in the arm 240*b* (or vice versa) before securing the two arms 240*a*, 240*b* together near the apex 18 or vertex 18. The pin 244 may be replaced by one or more legs passing through the arm 240*a* or straddling the arm 240*a*. Meanwhile, an extension 263 or leg 263 may extend from the leg 240*a* as a stabilizer 263. The stabilizer 263 as a single or double extension 263 contacts the cap 234 to render the arm 240*a* virtually fixed with respect to the handle 234 or cap 234 portion of the container 232. Thus, only the arm 240*b* moves with respect to the handle 234 and the wand 240*a* or arm 240*a*.

Typically, the pin 244 may be placed on the opposite side of the cross over point of the vertex 18. This provides a better leverage advantage for a user. Meanwhile, all of the advantages of a crossover configuration described hereinabove accrue to this embodiment. Meanwhile, the stability in the relative positions of both brushes 238 is assured by the registration between the arms 240. Meanwhile, the arms 240 themselves (e.g., by one passing through the other in a captured condition), the pin 244 (e.g., fixed to an arm 240*b* and passing through an aperture 246 in the arm 240*a*), or both may provide stabilization (alignment for relative motion in a radial/transverse/orthogonal-to-axial direction) between the two arms 240. Most importantly, precise alignment of the brushes 238 in their actuation toward opening, and returning, may be assured.

Figure 24:
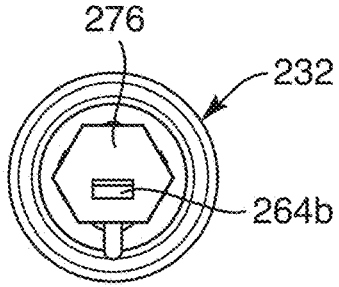
FIG. 24 is a top plan (end) view of an applicator or handle with the actuator removed.

Referring to FIG. 24, in one embodiment, barbs 264*a* may secure the arms 240 together near a vertex 18. Meanwhile, another barb 264*b* may pass through a fitting 268 to be secured to the cap 234. For example, FIG. 24 illustrates the cap 234 with the barb 264*b* passing therethrough by means of deflectable decks 276 or flaps 276 that deflect to receive and capture the barb 264*b*. This locates the fitting 268 snuggly inside the cap 234 and secures the assembled arms 240 in the cap 234.

Figure 25:
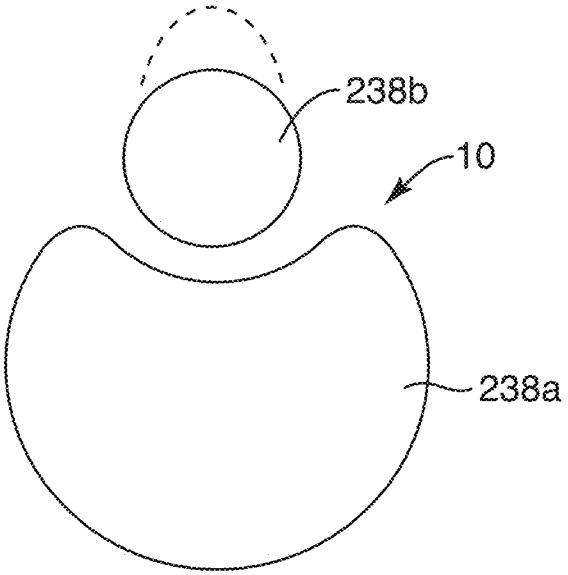
FIG. 25 is a schematic, bottom, plan (end) view of one embodiment of a pair of brushes of differing size and shape in an open or spaced apart configuration.
Figure 26:
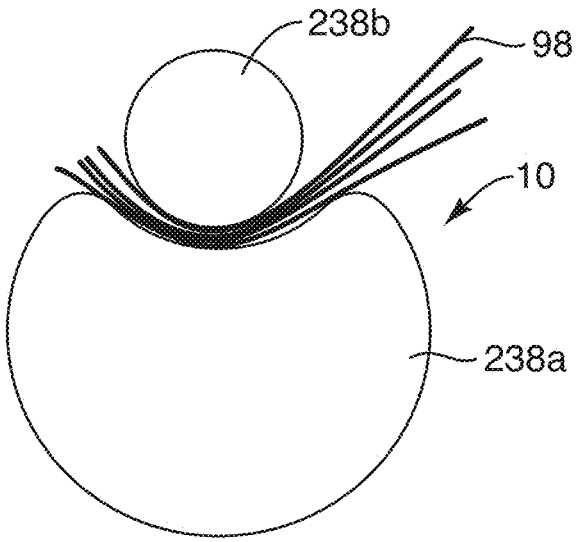
FIG. 26 is a schematic, bottom, plan (end) view of the brushes of FIG. 25 illustrating closure therebetween and engagement of lashes for applying cosmetic products, such as mascara.

Referring to FIGS. 25 and 26, the brushes 238*a*, 238*b* may have different axial cross sections, and different sizes. In the illustrated embodiment, curling may be enhanced by wrapping one brush 238*a* around a portion of another brush 238*b*. Thus, a user can rotate the brushes 238 in the closed configuration with a lash 98 captured therebetween, and rotate the cap 234 easily, while the brushes 238 remain closed together on the lash 98.

Figure 27:
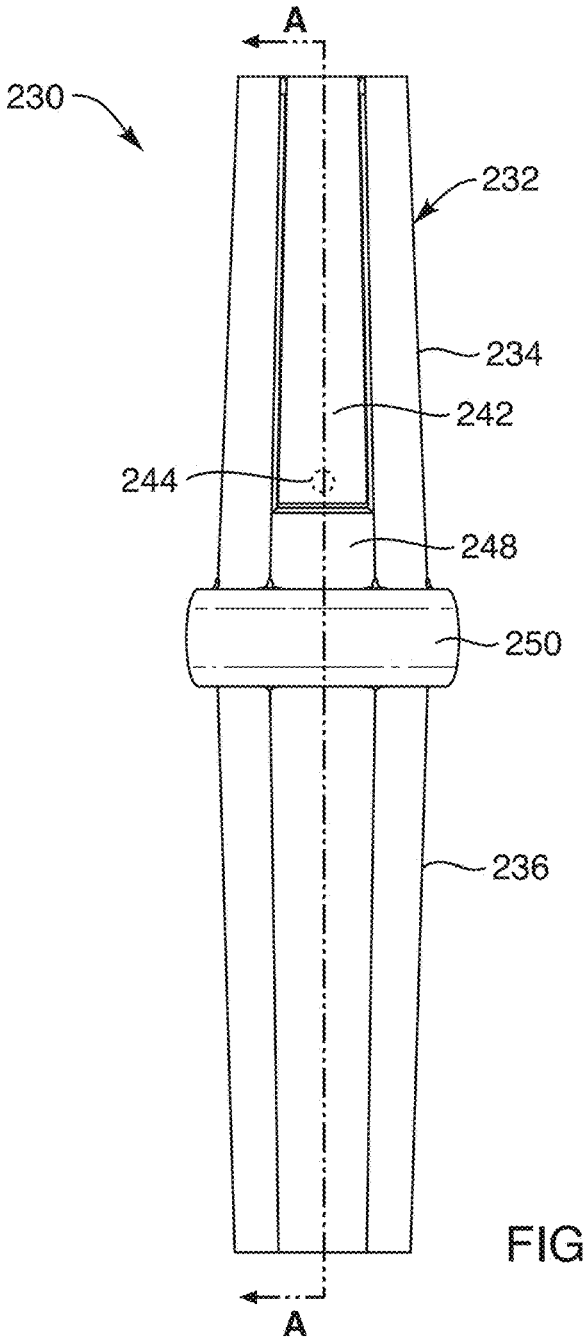
FIG. 27 is a front elevation view of a container or case of one embodiment of a system in accordance with the invention.
Figure 28:
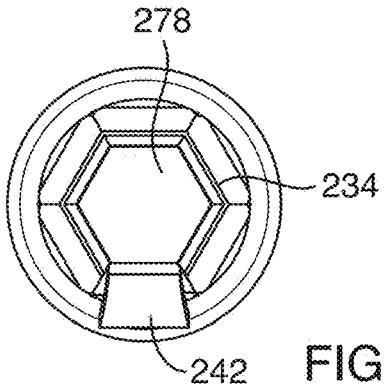
FIG. 28 is a top plan (end) view thereof.
Figure 29:
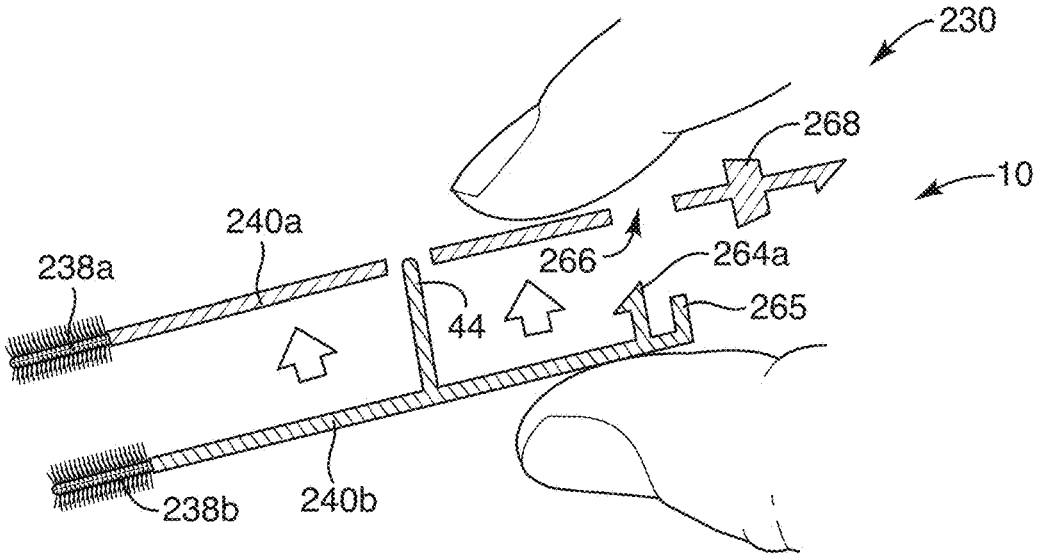
FIG. 29 is a front elevation view of one embodiment of a wand assembly for the applicator illustrating an assembly method suitable for the invention.

Referring to FIGS. 27 and 28, the actuator 242 may be fitted into a tray 248 or relief 248 formed in the cap 234. This may reduce the profile. The location of the pin 244 is illustrated by broken lines indicating it is hidden under the actuator 242. Meanwhile, an end cover 278 may be secured to the actuator 242, in order to seal the end of the cap 234, with its attendant several components therein.

Referring to FIGS. 29 through 32, operation of a system 230 in accordance with the invention is illustrated. In this embodiment, the arms 240 may be assembled by passing the barbs 264 through an aperture 266. The registration stub 265 need not contain a barb 264, but may. Accordingly, the stub 265 and the barb 264 fit within the aperture 266 following deflection by the barb 264 in order to enter the aperture 266.

Figure 30:
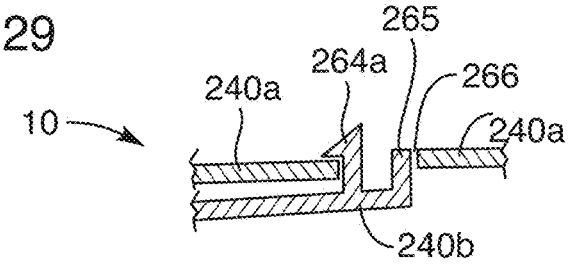
FIG. 30 is a front, elevation, cross-sectional view of a detail of a wand-to-wand securement mechanism of FIG. 29.

Referring to FIG. 30, the assembled configuration of the barb 264 and the aperture 266 are illustrated, with the stub 265 in place.

Figure 31:
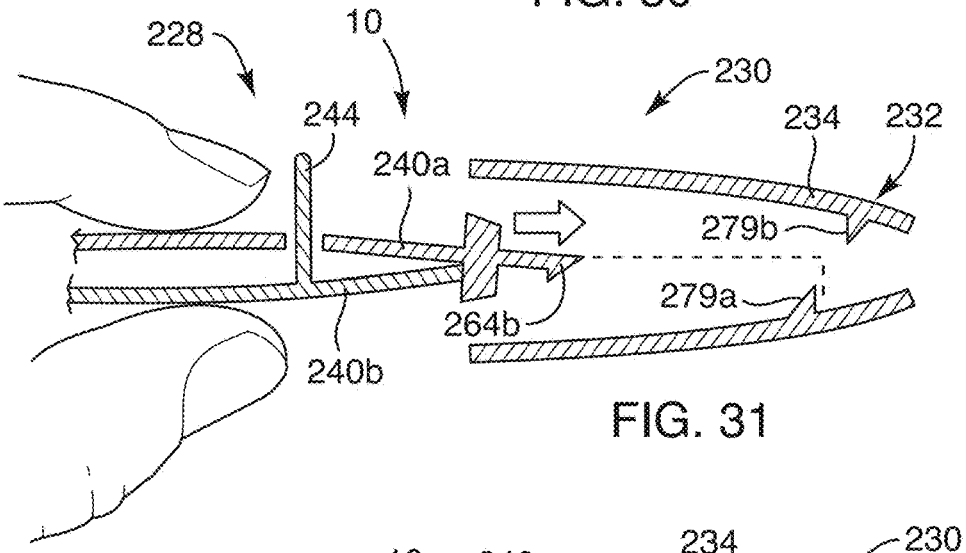
FIG. 31 is a front, elevation, cross-sectional view of an applicator-to-cap (of FIG. 29) assembly process of inserting assembled wands into a cap (handle) of a container in accordance with the invention.
Figure 32:
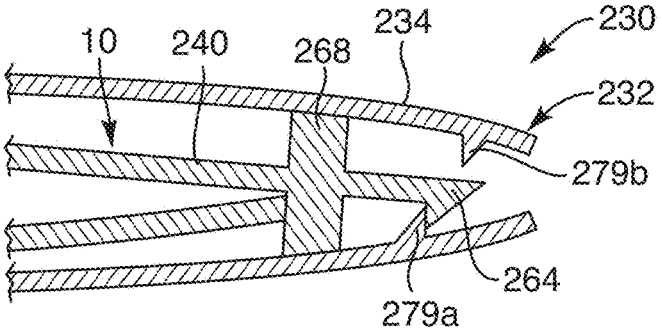
FIG. 32 is a front, elevation, cross-sectional view thereof in an assembled configuration.

Referring to FIGS. 31 and 32, an assembly of the applicator 228, 10 may be fitted into the cap 234 in which the barb 264*b* is fitted to the cap 234, passing and locking to a buttress 279*a* in the cap 234. Meanwhile, another buttress 279*b* may capture the seal cap 281 in the end of the cap 234. FIG. 32 shows the arrangement of the components in an assembled configuration.

Figure 33:
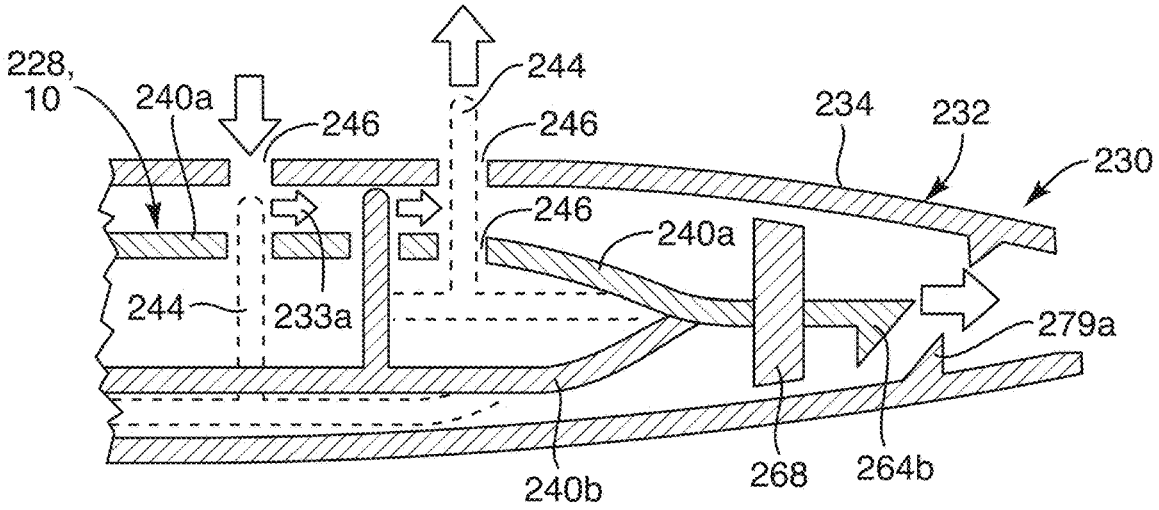
FIG. 33 is a front, elevation, cross-sectional view of one embodiment of an applicator in a process of assembling, illustrating positioning, locking positions, and the locations of a guide pin that serves to apply force between the arms to spread them, all in a process of being inserted into a cap.
Figure 34:
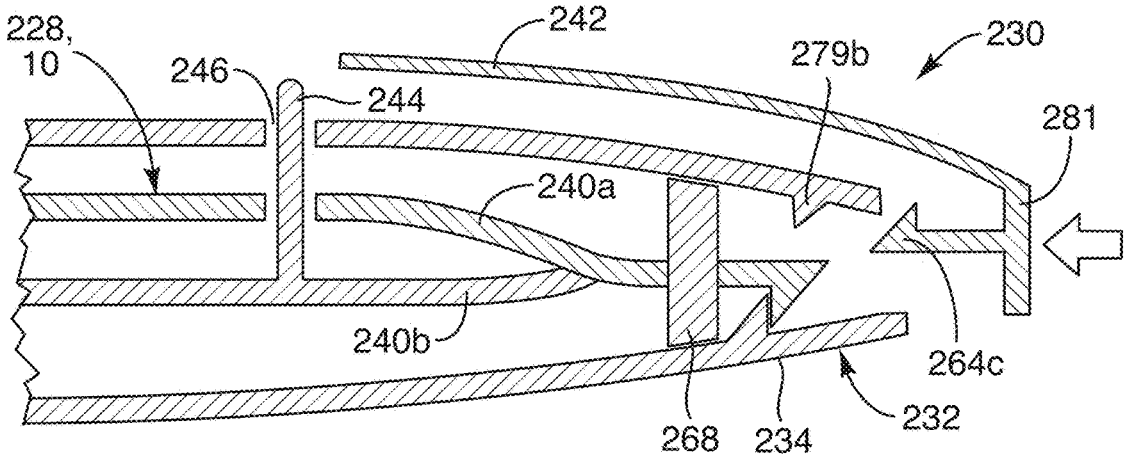
FIG. 34 is a front, elevation, cross-sectional view thereof in an assembled configuration, with the actuator element in a process of being assembled.
Figure 35:
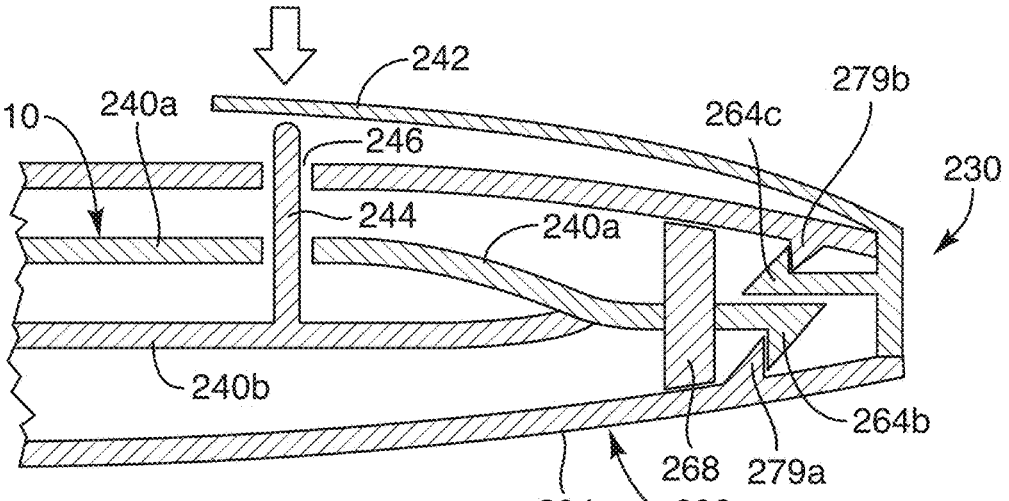
FIG. 35 is a front, elevation, cross-sectional view thereof with the actuator snapped into place in the cap to be operable with the guide pin.

Referring to FIGS. 33 through 35, insertion of an applicator 10 into a cap 234 may involve depressing the pin 244 in order to pass the pin 244 in the longitudinal direction 233*a* into the cap 234. Eventually, the pin 244 aligns with the aperture 247 in the cap 234, at which point the pin 244 may pop back through the wall of the cap 234 into an operational position. Meanwhile, the fitting 268 is seen to pass through the interior of the cap 234, eventually passing the barb 264*a* passed the buttress 279*a* to secure the fitting 268 inside the cap 234.

Referring to FIG. 34, the applicator 10, 228 is now fitted inside the cap 234, while the seal cap 281 passes into an opening in the cap 234 in order to capture the barb 264*c* under a buttress 279*b*.

Referring to FIG. 35, the assembled configuration with the barbs 264*a*, 264*b*, 264*c* captured by their respective buttresses 279*a*, 279*b*.

Figure 36:
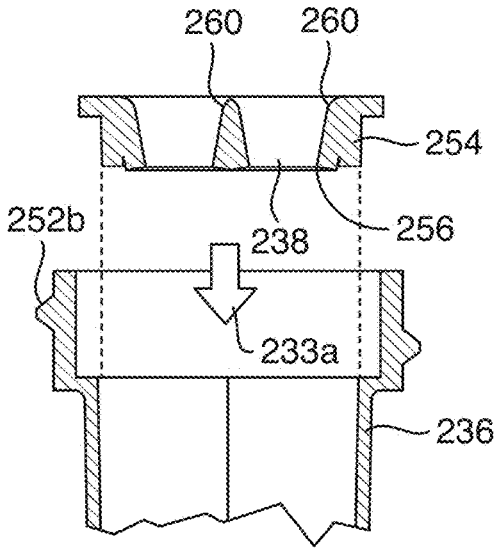
FIG. 36 is a front, elevation, cut-away, cross-sectional view of one embodiment of a base or reservoir portion of a container in the process of receiving a closure (seal) containing the wipers for brushes in accordance with the invention.

Referring to FIG. 36, one embodiment of a closure 254 is shown with its sockets 260 being inserted in a longitudinal direction 233*a* into the base 236. The closure 254 fits snuggly, and will typically be formed of an elastomeric material much softer and much more flexible than the material of the base 236. Accordingly, the edges 256 of the apertures 258 will act as wipers 256 for the bristles of the brushes 238 passing therethrough with product retrieved from the reservoir 236 or base 236.

Figure 37:
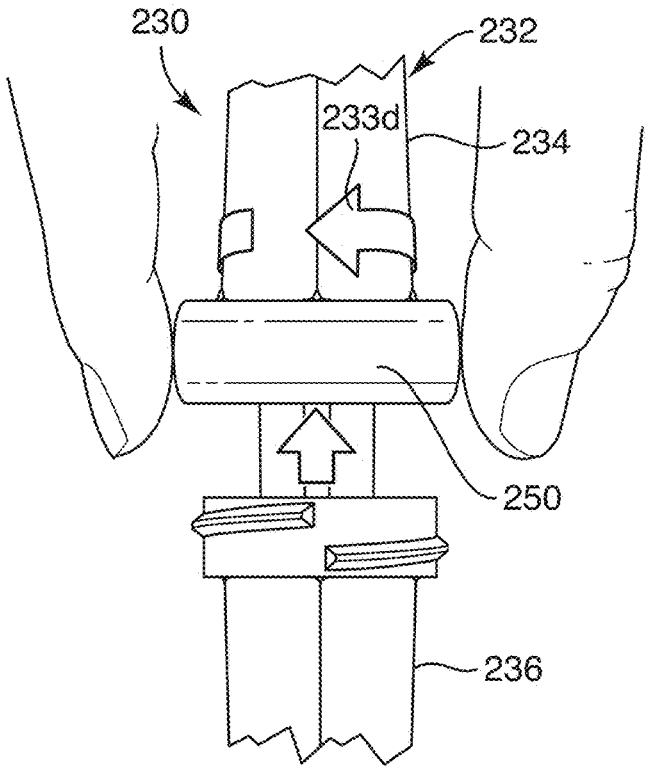
FIG. 37 is a front, elevation, cut-away view of a central portion of a case illustrating a closure operation in a system in accordance with the invention.

Referring to FIG. 37, the circumferential direction 233*d* may operate forward or backward in order to thread the collar 250 onto the base 236, and to uncouple it from the base 236.

Figure 38:
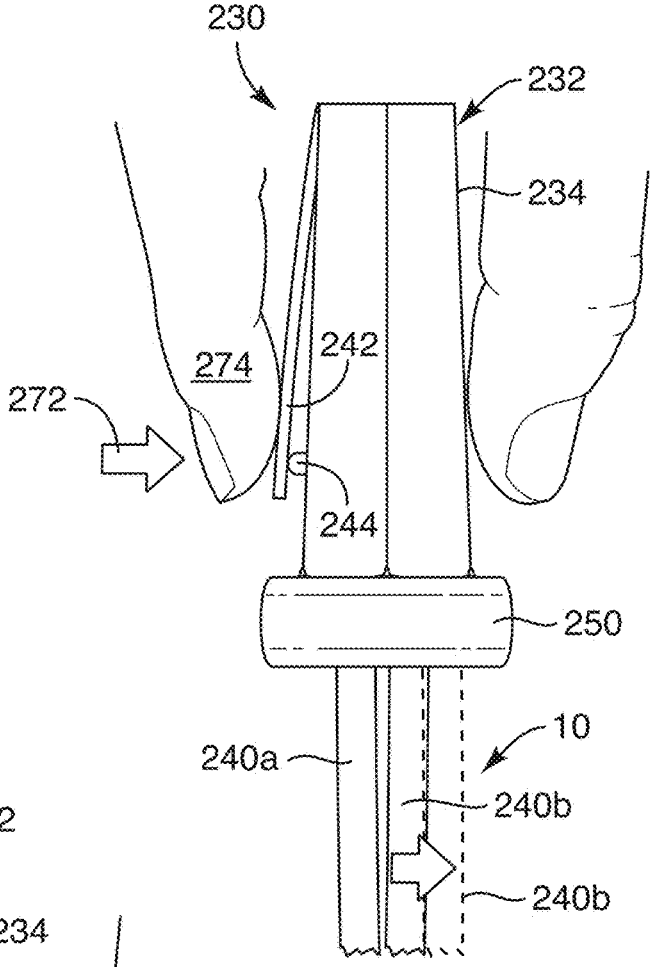
FIG. 38 is a front, elevation, cut-away view of one embodiment of a cap of a container in accordance with the invention, containing an applicator and illustrating actuation separating wands.

Referring to FIG. 38, operation of the pin 244 by the actuator 242 in response to a force 272 by a finger 274 of a user thereon is illustrated. The positions of the comparatively more flexible on 240*b* are illustrated. Thus, the two arms 240*b* are actually a default position between the flexed position of the arm 240*b* and the arm 240*a*.

Figure 39A:
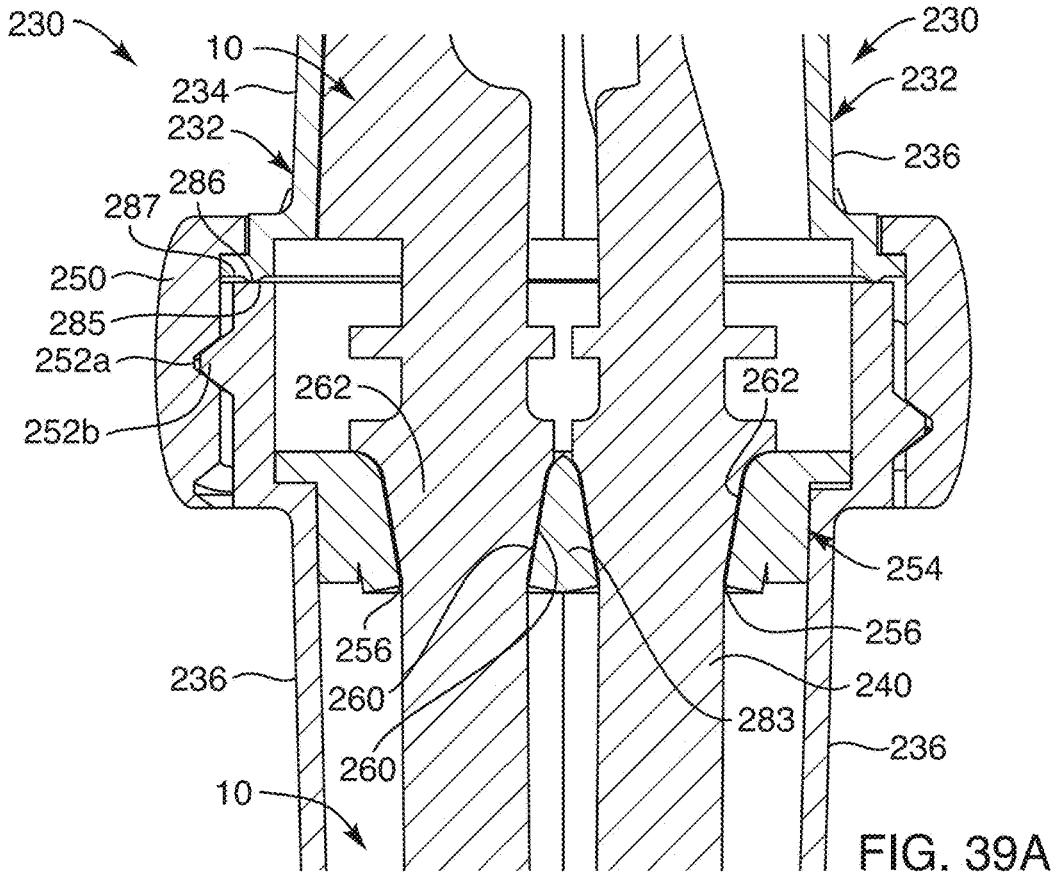
FIG. 39A is a front, elevation, cut-away, cross-sectional view of a detail (riser or rim on a face) near the center of a case, illustrating sealing mechanisms about the arms and wipers of a system in accordance with the invention.
Figure 39B:
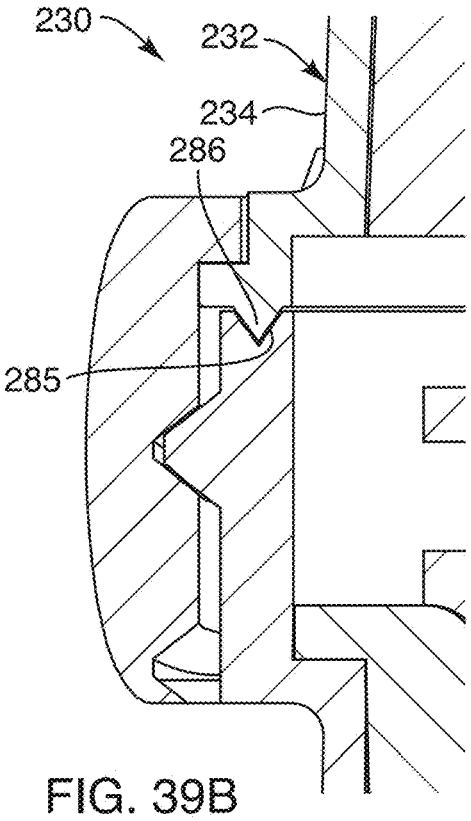
FIG. 39B is a front, elevation, cut-away, cross-sectional view of a detail (riser or rim in a groove) of the mechanism of FIG. 39A illustrating an alternative embodiment for a seal between a cap and a closure associated with the base to be sealed by force of the collar.
Figure 39C:
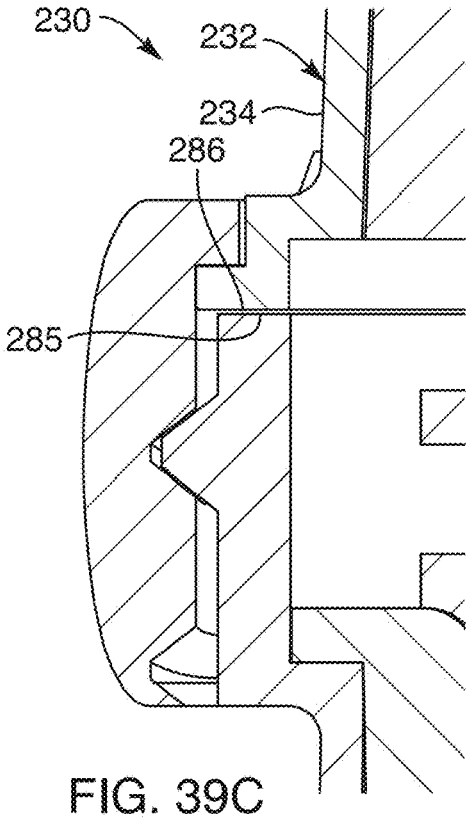
FIG. 39C is a front, elevation, cut-away, cross-sectional view of a detail illustrating an alternative embodiment for a face seal between a cap and a closure associated with the base to be sealed by flat contact.

Referring to FIGS. 39A, 39B, and 39C details of the arms 240 in the closed position with the collar 250 securing the cap 234 against the shoulder 282 of the closure 254 demonstrate the fitting the sockets 260 with the stoppers 262. Seals may be made at the diagonal or conical surfaces 260 or at the top shoulder 283 or bottom shoulder 284, or any combination thereof. The edges 256 may be shaped to operate as wipers 256 by making the edges 256 sharp corners, or even under cutting them to become narrow, blade like triangular shapes that will tend to peel additional produce from the brushes 238 and return it back into the bulk supply within the reservoir portion 234 or base 234.

Referring to FIGS. 39B and 39C alternative embodiments for sealing the shoulder 282 against the cap 234 may involve a surface 285 fitted to a mating surface 286 formed or simply imposed in the closure 254 and matched to a ridge 286 formed in the corresponding shoulder 287 of the cap 234. Alternatively the face-to-face seal with elastomeric surfaces on at least one side serves in FIG. 39C.

Referring to FIG. 39C, flat seals in a face-to-face configuration may serve to seal the system 10. In fact, so long as the reservoir 236 is sealed by the stopper 262, no other sealing need be required, and vice versa.

Figure 40:
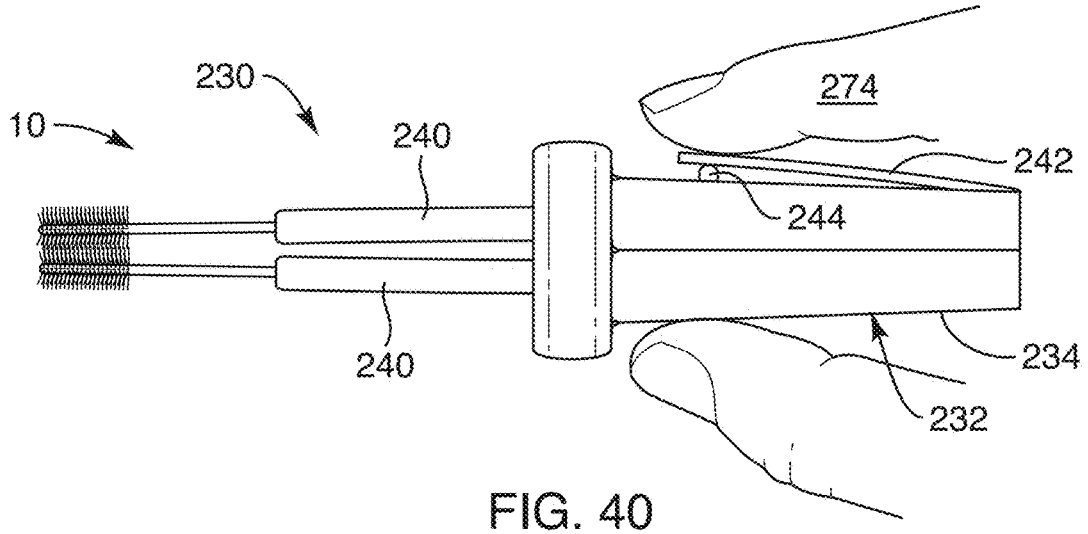
FIG. 40 is a right side, elevation view of an applicator installed in a cap with an actuator for operating the guide pin to move the arms away from one another for "loading" with product (mascara)

Referring to FIGS. 40 through 43, certain assembly details are illustrated. For example, FIG. 40 illustrates operation of the actuator 242 on the pin 244 under a force from a finger 274. The system 230 relies on a closed configuration. Meanwhile, FIG. 42 simply represents operation of the collar 250 rotating in response to a grip and turning motion by fingers 274 of a user. The end seal cap 281 with its attached actuator 242, will fit into their respective locations inside the cap 234.

Figure 41:
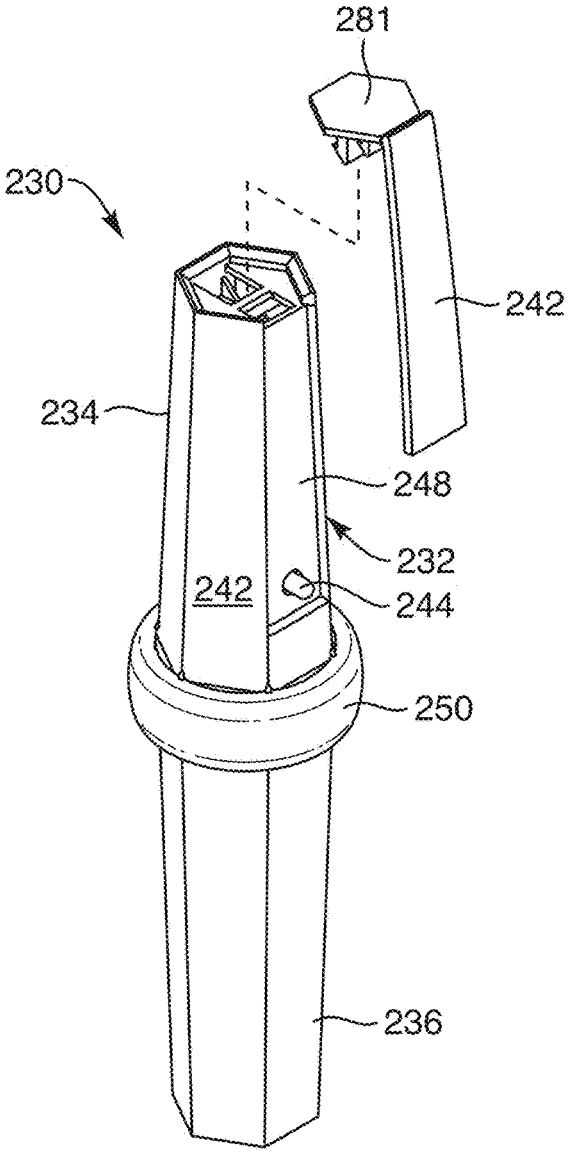
FIG. 41 is a perspective view thereof secured by the collar to a base or reservoir portion of a system but with the actuator exploded away to show the pin.
Figure 42:
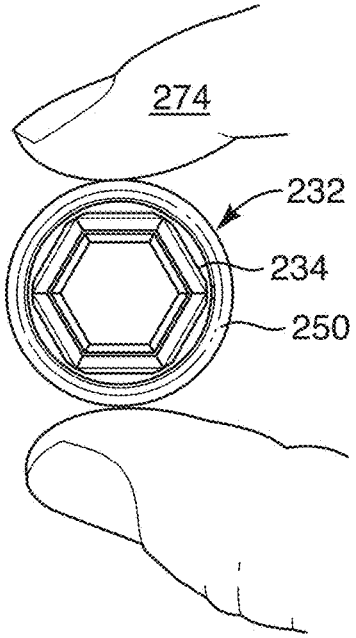
FIG. 42 is a bottom end, plan view of the container for a system of FIG. 41.
Figure 43:
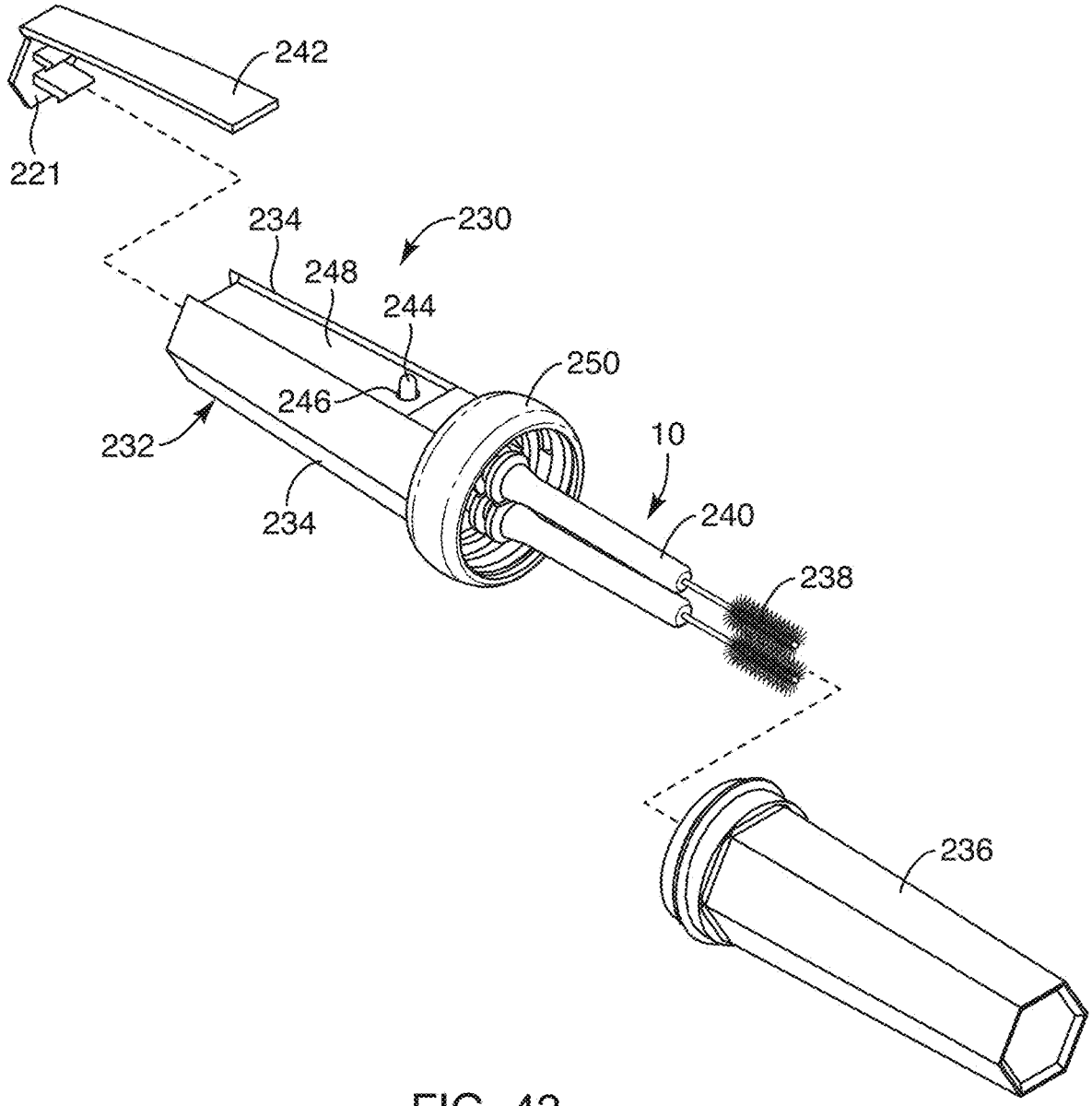
FIG. 43 is an exploded, perspective view of the system in accordance with the invention.

Actuation of the actuator 242 is by a finger 274. FIG. 41 illustrates the actuator 242 exploded to show the pin 244, but ready to be inserted into the cap 234. The cap 232 receives the actuator 242 and seal cap 281. Once the actuator 242 is in place. FIG. 42 is simply the assembled bottom view. FIG. 43 is an exploded perspective view.

Figure 44:
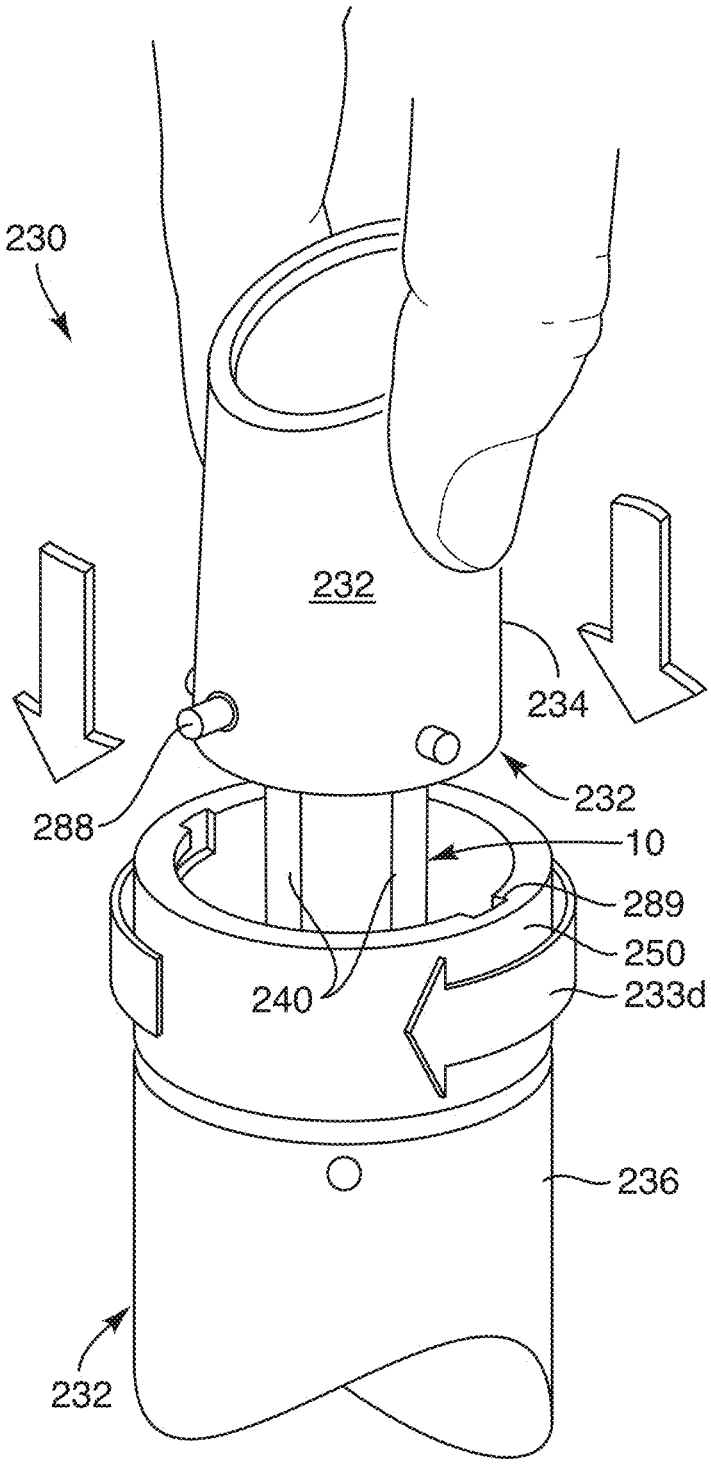
FIG. 44 is a perspective view of an alternative embodiment of structures for locking a cap to a base in a container and system in accordance with the invention.
Figure 45:
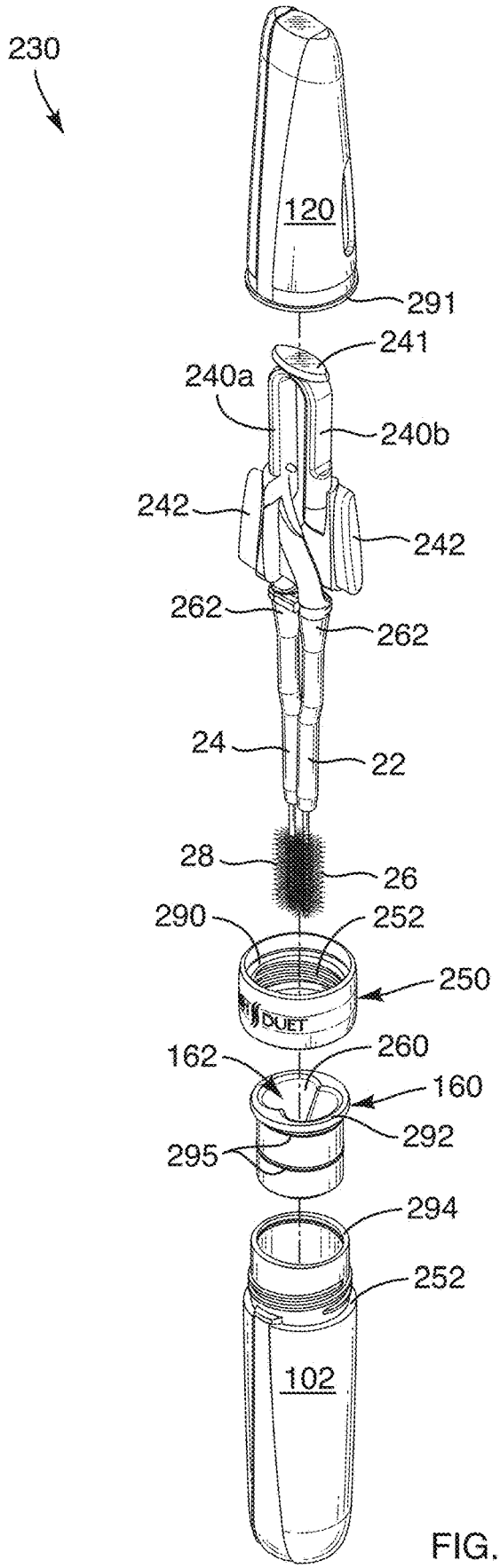
FIG. 45 is an exploded view of one alternative embodiment of a system or apparatus in accordance with the invention.

Referring to FIG. 44, illustrated is an alternative embodiment in which studs 288 may extend from a cap 234 and fit into receivers 289 formed in the base 236. Rotating in the circumferential direction 233*d* will lock the studs 288 or release the studs 288, alternatingly from the receivers 289.

Figure 63:
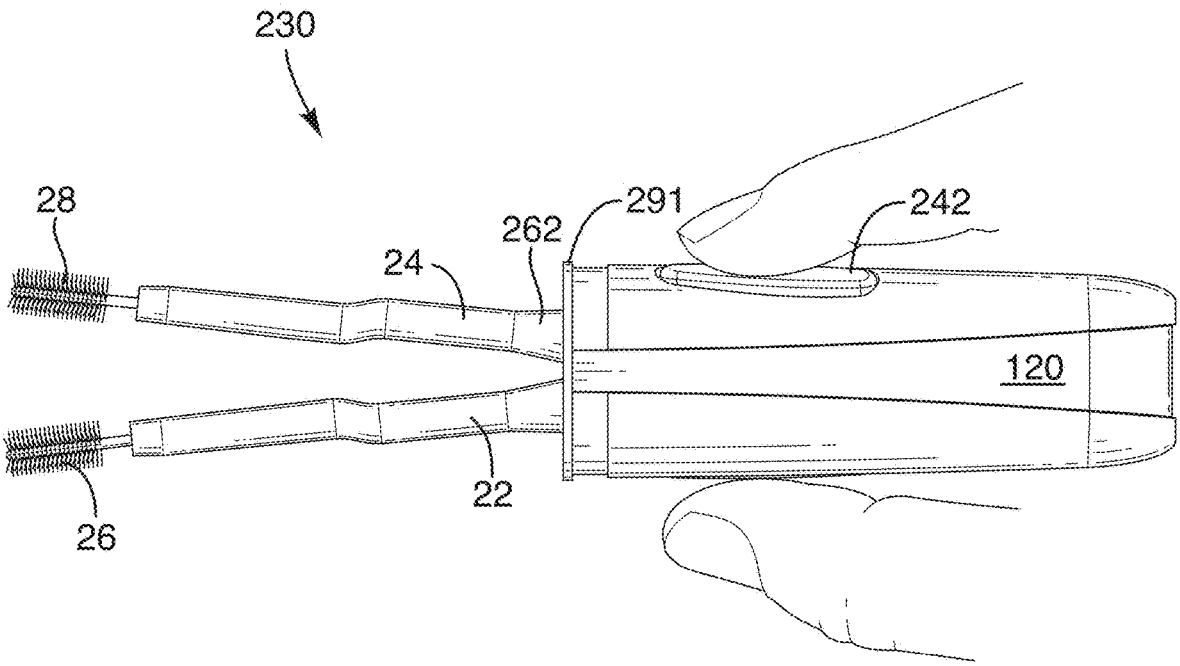
FIG. 63 is a front, elevation view of the handle portion in an orientation suitable for operation by a user to open the brushes against the biasing forces (always present, and otherwise dominant in the absence of force applied by a user)
Figure 64:
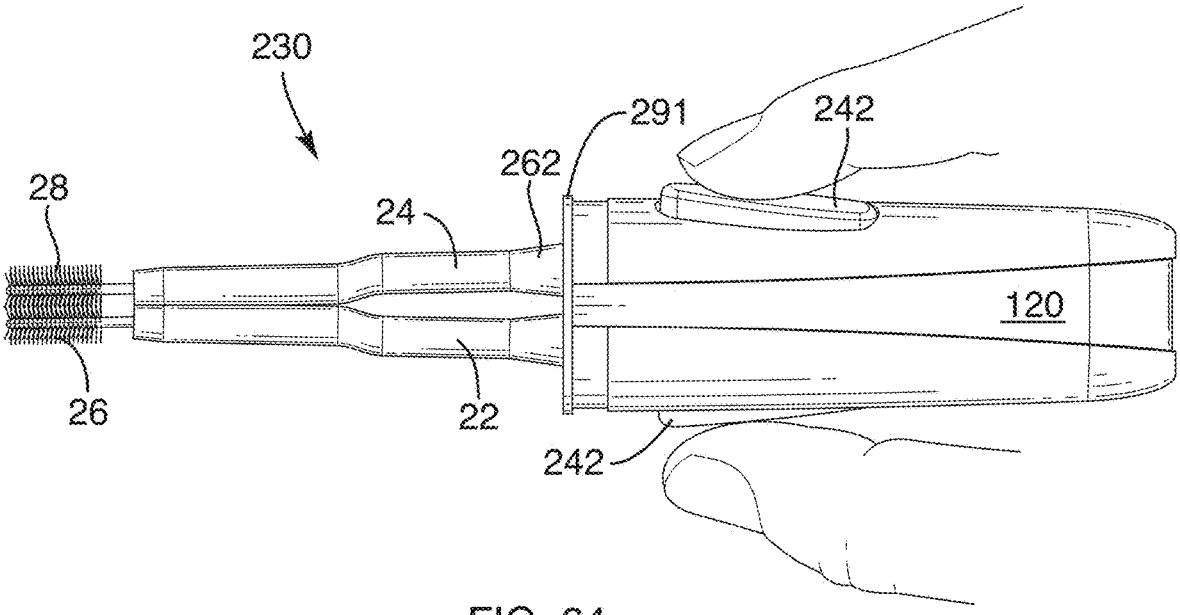
FIG. 64 is a front, elevation view of the apparatus of FIG. 63 held in a horizontal orientation ready for use, as it would be positioned when capturing eyelashes between the brushes in order to apply a mascara product.

Referring to FIGS. 45 through 54, while referring generally to FIGS. 45 through 64 and more generally FIGS. 1 through 64, a system 230 may include a container 100 separable into separate parts 102, 120. A lower portion 102 acts as a receptacle portion 102. A cap portion 120 also acts as a handle portion 120. These components 102, 120 together contain an applicator made up of arms 240*a*, 240*b* connected together in such a way as to create a permanent bias between them urging the arms 240*a*, 240*b* apart. The arms 240*a*, 240*b* tend to separate and will only move toward one another when actuators 242 or pressure points 242 are squeezed together by the fingers of a user.

Whenever the arms 240*a*, 240*b* are pressed toward one another by the application of force or pressure to the actuators 242 or pressure points 242, the wands 22, 24, which are extensions of the arms 240*a*, 240*b* in this embodiment, move apart. Thus, the brushes 26, 28 attached to the respective arms 240*a*, 240*b* (by wands 22, 24) likewise separate. The natural or unforced positon of the arms 240*a*, 240*b* is apart, the wands 22, 24 together, and brushes 26, 28 together.

A collar 250, provided with internal threads 252 matching external threads 252 on the receptacle 102, is permanently and rotatably attached to the cap portion 120 by fitting a rim 290 inside the collar 250 above the rim 291 or lip 291 on the cap 120 or cap portion 120. Thus, the collar 250 rotates freely with respect to the cap 120 or handle 120 but need not separate therefrom.

Typically, the arms 240*a*, 240*b* are secured by any suitable fastening mechanism, such as glue, barbs, or other mechanisms known in the art, to remain inside the cap 120. The collar 250 in use may be threaded such that the threads 252 of the collar 250 will engage with the threads 252 of the receptacle 102 to close the container 100. In this way, an intermediate tool 160 or squeegee 160 may fit inside the receptacle 102 captured under pressure applied by the collar rim 290 against the rim 291, itself pressing against the rim 292 of the squeegee 160.

The openings 162 or ports 162 are provided for passage of the brushes 26, 28 and wands 22, 24 into and through the squeegee 160 and ultimately into the receptacle 102. The squeegee 160 or tool 160 will typically include a seating surface 260 to contact the stoppers 262 on wands 22, 24 sealing the receptacle 294. Meanwhile these seals 295 on the tool 160 may fit inside relief furrows or channels formed inside the receptacle 102, which effect tends to hold the seals 295 within the receptacle 102. Thus, once closed completely, the cap 120 is drawn toward the receptacle 102 by the collar 250. The rim 290 of the collar 250 draws the rim 291 of the cap 120 down against the rim 292 of the squeegee 160. Thus, the rim 292 also seals against the lip 294 or rim 294 of the receptacle 102.

The pressure brought to bear between the rim 291 of the cap 120 and the rim 294 of the receptacle 102 captures the flexible rim 292 captured between the rims 291, 294 to effect closure therebetween, effecting a vapor-proof and liquid-proof seal. Meanwhile, the wands 22, 24 include portions 252 operating as a seal 262 or stopper 262 fitted and pressed into the surfaces 260 of ports 162 in the squeegee 160. Thus, all passages for vapor or liquid to escape from the receptacle 102 are blocked when the entire system 230 is assembled with the collar 250 providing the closing force.

Figure 46:
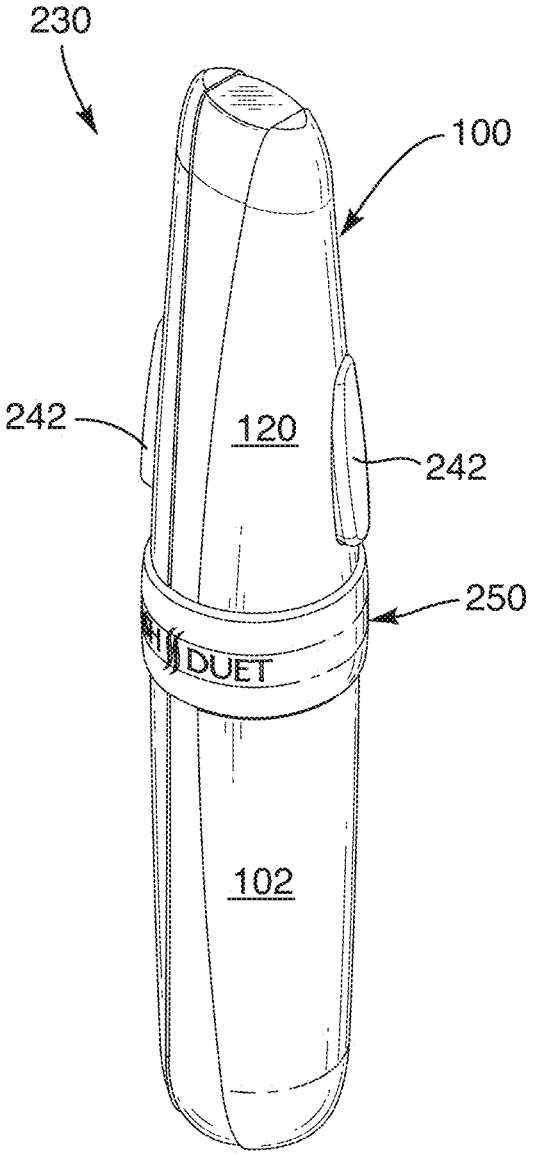
FIG. 46 is a frontal, upper perspective view of the apparatus of FIG. 45 in a closed position.
Figure 47:
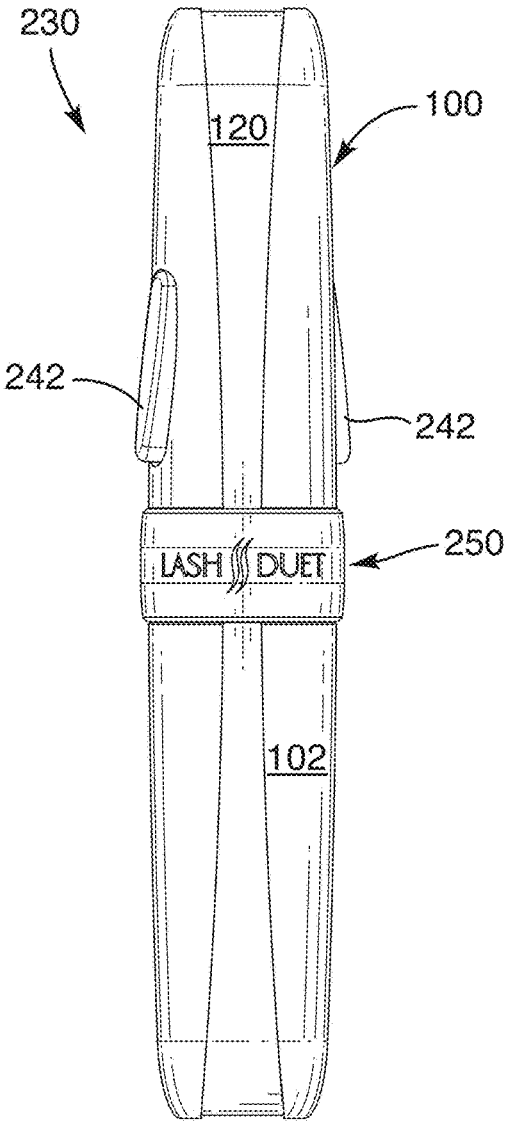
FIG. 47 is a front, elevation view thereof.
Figure 48:
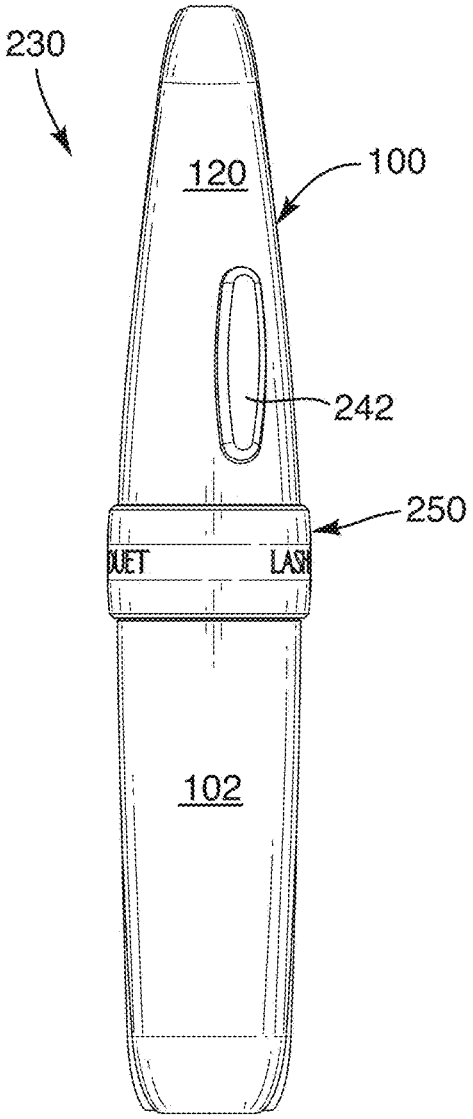
FIG. 48 is a right side, elevation view thereof, the left side view being virtually a mirror image thereof.
Figure 49:
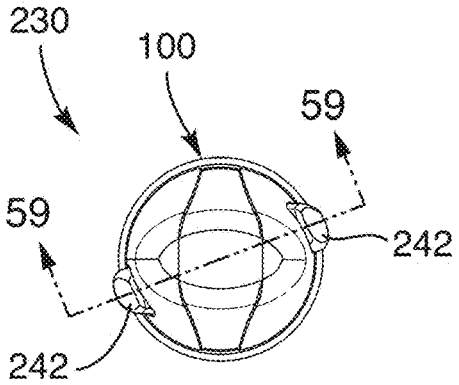
FIG. 49 is a top plan view thereof.
Figure 50:
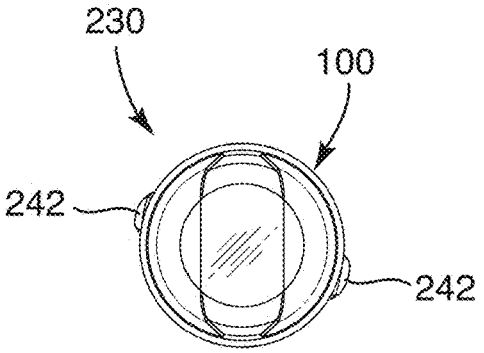
FIG. 50 is a bottom plan view thereof.
Figure 51:
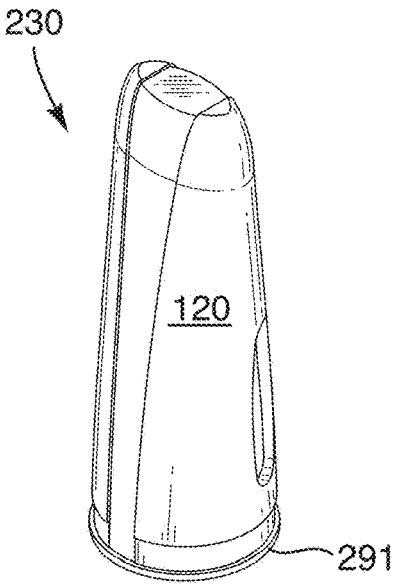
FIG. 51 is an upper, perspective view of the cap or handle portion thereof.
Figure 52:
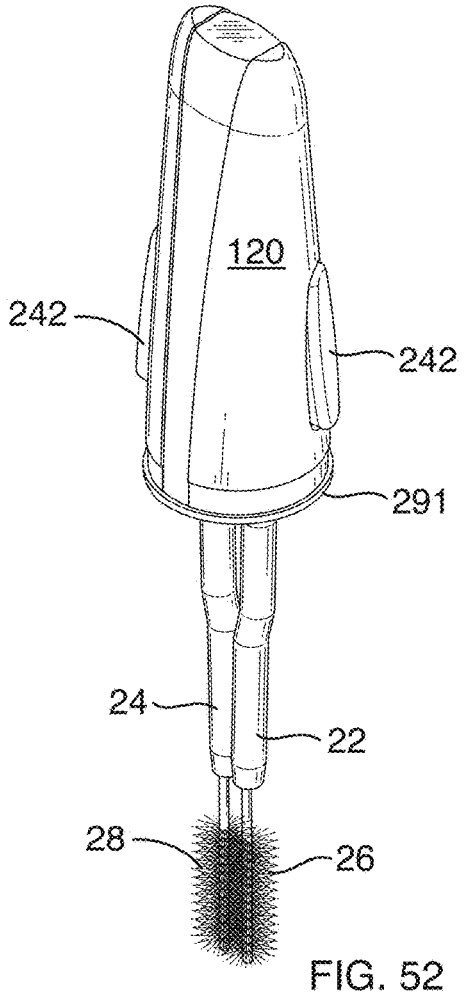
FIG. 52 is an upper, perspective view of the cap portion or handle portion illustrating the dual brushes biased toward one another by the apparatus.
Figure 53:
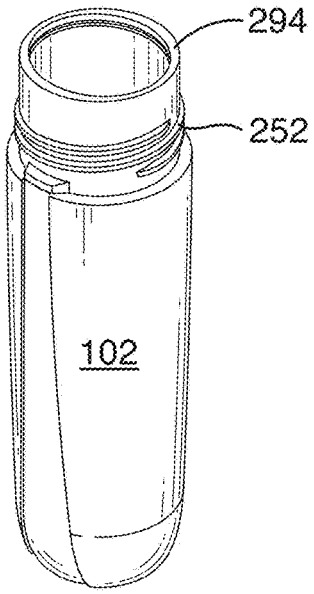
FIG. 53 is an upper, perspective view of the receptacle portion of the container of the apparatus of FIGS. 45 through 54.
Figure 54:
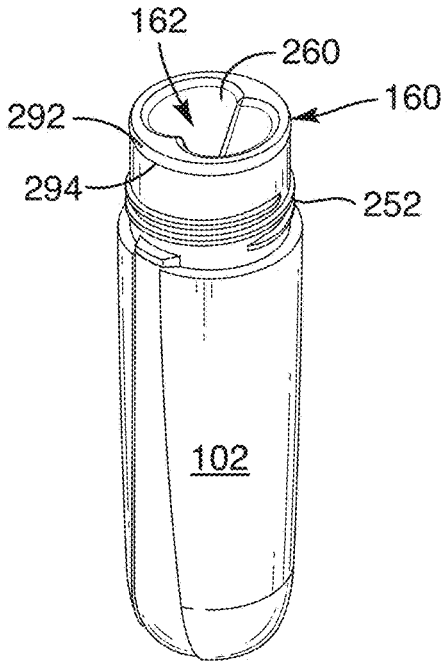
FIG. 54 is an upper, perspective view of the lower or receptacle portion of a container in accordance with the invention illustrating the squeegee tool inserted therein as in condition to be used with a product in the container.

Referring to FIG. 46, the container 100 comprising the receptacle 102 and the cap 120 is penetrated at the cap 120 by the actuators 242 extending from the arms 240*a*, 240*b*. Scaling these actuators 242 with respect to the cap 120 is an exercise in complexity if not absolute futility. Thus, all sealing requirements are instead met by the stoppers 262 in contact with the scaling surfaces 260 of the ports 162, the 'O' ring seals 291 on the tool 160, as well as the rim seals 291, 292, 294.

Figure 59:
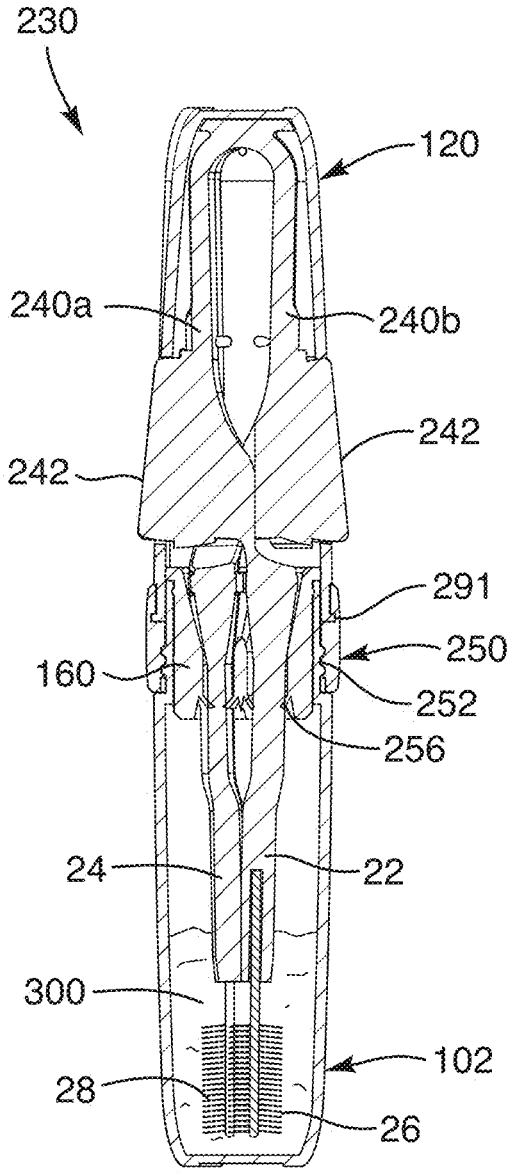
FIG. 59 is a front, elevation, cross-sectional view of the apparatus of FIGS. 45 through 58 in a fully assembled, closed, sealed, biased closed position, with the brushes submerged in the product contained therein.

Referring to FIGS. 47 through 50, the profiles of the actuators 254 are more clear, and the section line for the view illustrated in FIG. 59 is provided. One will notice that a comparatively symmetric, circular profile exists in order to provide both a slim and trim apparatus 230 or system 230. It becomes a convenient operational shape for rotation of the squeegee tool 160 within the receptacle 102, and the rotation of the wands 22, 24 within the receptacle.

The ability to rotate both wands enables a user to pick up product 300 from the receptacle and to distribute that product 300 throughout the entire circumference of each brush 26, 28. These functionalities have been found to be valuable for several reasons, including uniformity of product 300 distribution on the brushes 26, 28. Moreover, interior loading is needed on brushes 26, 28 hen contacting the eyelashes. This provides a start on creating an even distribution before any excess is wiped from the brushes 26, 28 when passing through the squeegee 160.

On the other hand, it has been found very difficult to manufacture the squeegee tool 160 in such a way that the flexibility to seal against the receptacle 102 and the ability to rotate with respect thereto are both accommodated. Accordingly the "dog leg" or offset in the wands has proven satisfactory for letting the wands "relax" in compliance with their biasing force and hold the brushes 26, 28 together. This reduces the tendency for mechanical creep (long term yielding in response to otherwise modest force loads) to which the plastic materials may be subject. Meanwhile, the distal ends of the wands 22, 24 being closer together in the biased "resting" position will be drawn apart as they pass through the ports 162 in the squeegee tool 160. This is advantageous for loading the brushes 24, 26, as described hereinbelow with respect to FIGS. 52-60

Referring to FIGS. 51 through 54, internal components are removed to show the design shapes of the cap 120 and receptacle 102 as well as the biased closed configuration of the wands 22, 24. When no pressure is applied to the actuators 242, the brushes 26, 28 are substantially interleaved or intertwined. Meanwhile, the squeegee 160 within the receptacle 102 is illustrated.

Figure 55:
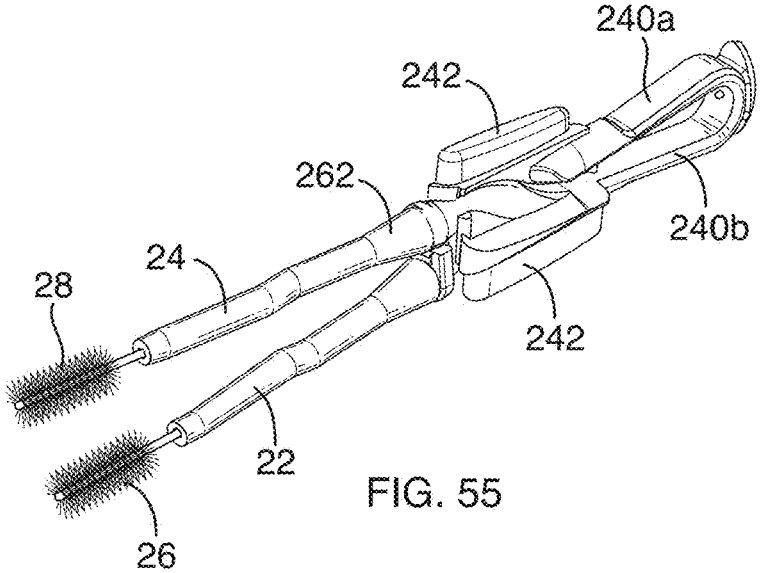
FIG. 55 is a perspective view of the internal arms, wands, and brushes of the apparatus of FIGS. 1 through 54, illustrating the biasing system connecting the arms and the actuators or pressure locations by which a user may apply force to separate the brushes from one another.
Figure 56:
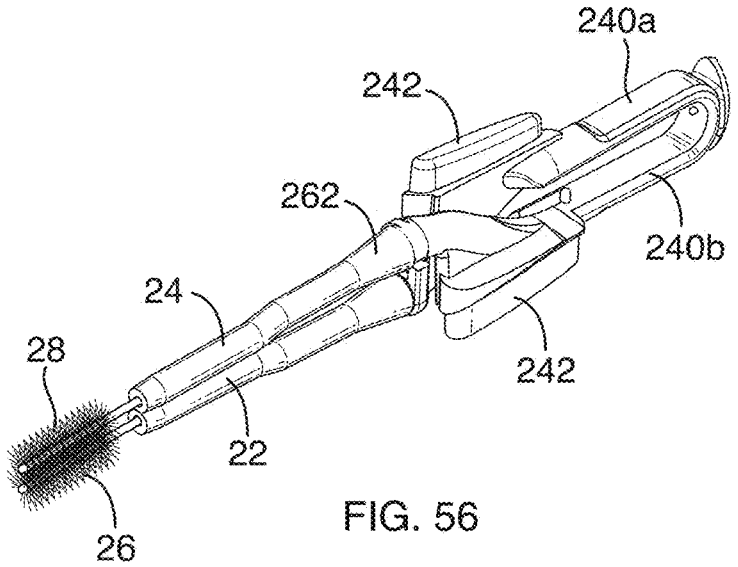
FIG. 56 is a perspective view of the components of FIG. 55, in their naturally biased, closed condition of the brushes.

Referring to FIGS. 55 through 56, the wands 22, 24 are illustrated in their position taken when the biased arms 240*a*, 240*b* are opposed by a force applied by a user to the actuators 242. This position is also obtained when the wands 22, 24 are partially withdrawn through the squeegee 160. The squeegee 160 itself resists the bias on the wands 22, 24 and the brushes 26, 28 in order to aid pickup of product 300 by the brushes 26, 28 from the receptacle 102.

Referring to FIG. 56, the position of the wands 22, 24 and brushes 26, 28 in the absence of force applied to the actuators 242 is to bias the arms 240*a*, 240*b* apart, and the wands 22, 24 and the brushes 26, 28 together, toward one another.

Figure 57:
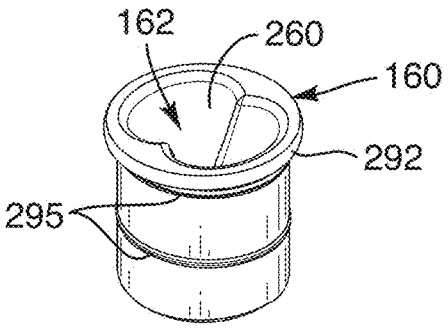
FIG. 57 is an upper, perspective view of the squeegee tool or insert that fits inside the receptacle in order to seal the product and receive the wands therethrough for both closure and for loading the brushes.
Figure 58:
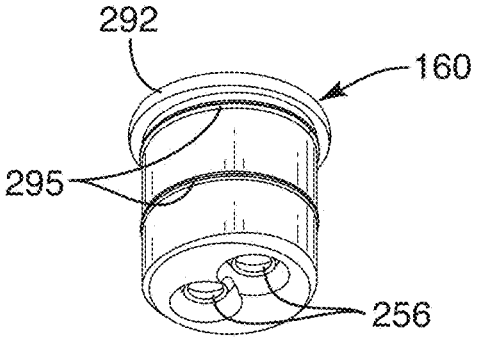
FIG. 58 is a bottom quarter, perspective view thereof.

Referring to FIGS. 57 and 58, the squeegee 160 shows seals 295, and the rim 292. The ports 162 or openings 162 expose the sealing surface 260 against which the stoppers 262 of the wands 22, 24 rest. The taper on the sealing surface 260 of the squeegee 160 makes a forcible contact with the scaling outer surface of the stopper 262. This not only provides a seal between the stopper 262 and the sealing surface 260 of the squeegee 160, but also tends to expand somewhat the squeegee 160 urging the squeegee 160 and its seals 295 (sealing rings 295 or built in 'O' rings 295) to more effectively seal against the inside walls of the receptacle 102.

Referring to FIG. 58, the lower end of the squeegee 160 forms the ports 162 into individual openings 162 terminating at a lip 256 or edge 256. This operates as a wiper 256, flexibly but firmly and elastically containing the wands 22, 24 and brushes 26, 28. As these are withdrawn from the receptacle 102 through the squeegee 160, they pass through the ports 162 individually.

Referring to FIGS. 59 through 62B, the operational sequence of the apparatus 230 appears. The sequence of operations illustrated ranges from a completely closed condition to a partially removed position on the way to an open, and then subsequently closed, position for applying product 300 to the eyelashes of a user. That sequence progresses a described hereinbelow.

Figure 60:
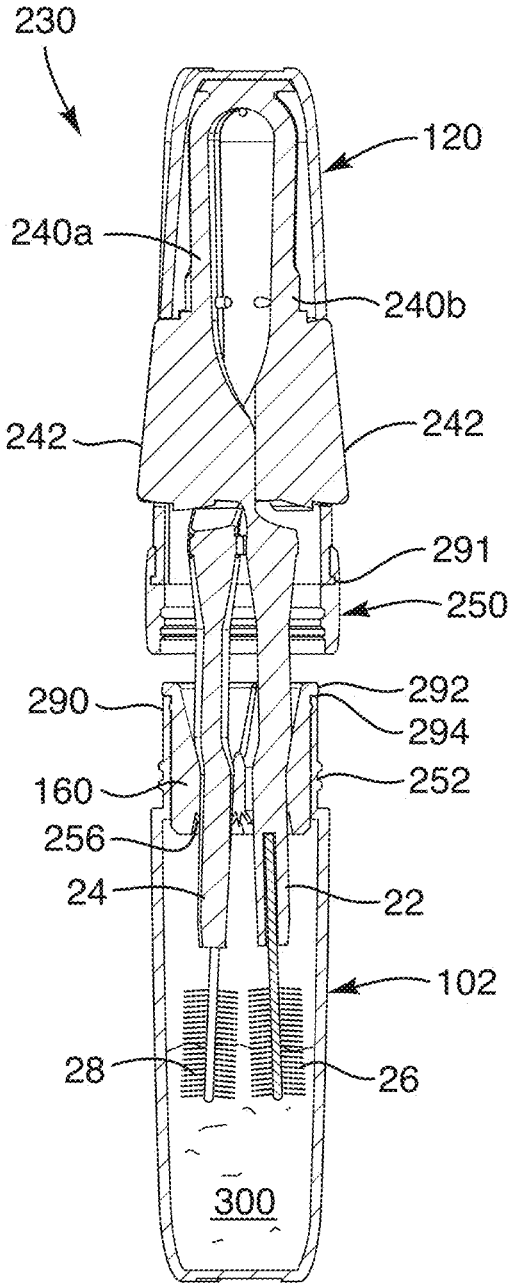
FIG. 60 is a front, elevation, cross-sectional view thereof with the wands partially withdrawn from within the product container, in which the squeegee tool has opened the wands apart from one another, and the brushes likewise, into a position for rotating the handle portion of the container along with its contained arm mechanism, thereby rotating the squeegee tool within the receptacle portion in order to load the brushes individually, and completely, including the portion of the brushes that will eventually make contact with one another when their biasing force permits or causes closure.

Referring to FIG. 60, the shape of the wands 22, 24, having a broader gap between them proximate the cap 120 and stoppers 262 or seals 262 a a closer proximity between the wands 22, 24 near the brushes 26, 28 causes a motion of the brushes away from one another as the wands 22, 24 are drawn longitudinally outward from the receptacle 102 through the ports 162. This provides several functional effects and benefits.

For example, as the wider-spaced portion of the wands move through the ports 162, the brushes 26, 28 and wands 22, 24 remain in their closest relationship. As the distal (lower, toward the brushes 26, 28) portions of the wands 22, 24 move through the ports 162, those wands 22, 24 must move apart, creating and increasing a gap between the brushes 26, 28. This separates the brushes 26, 28 from one another and places them near the inner surface of the receptacle 102 where they can pick up product 300 about the entire circumference of each brush 26, 28. Moreover, at this position, the wands are easily and freely movable back and forth (principally laterally or radially, but even circumferentially and longitudinally to some extent). Thus, this separation by overcoming the bias applied to the wands 22, 24 provides brushes 26, 28 fully loaded with product 300 about their entire circumferences.

Figure 61:
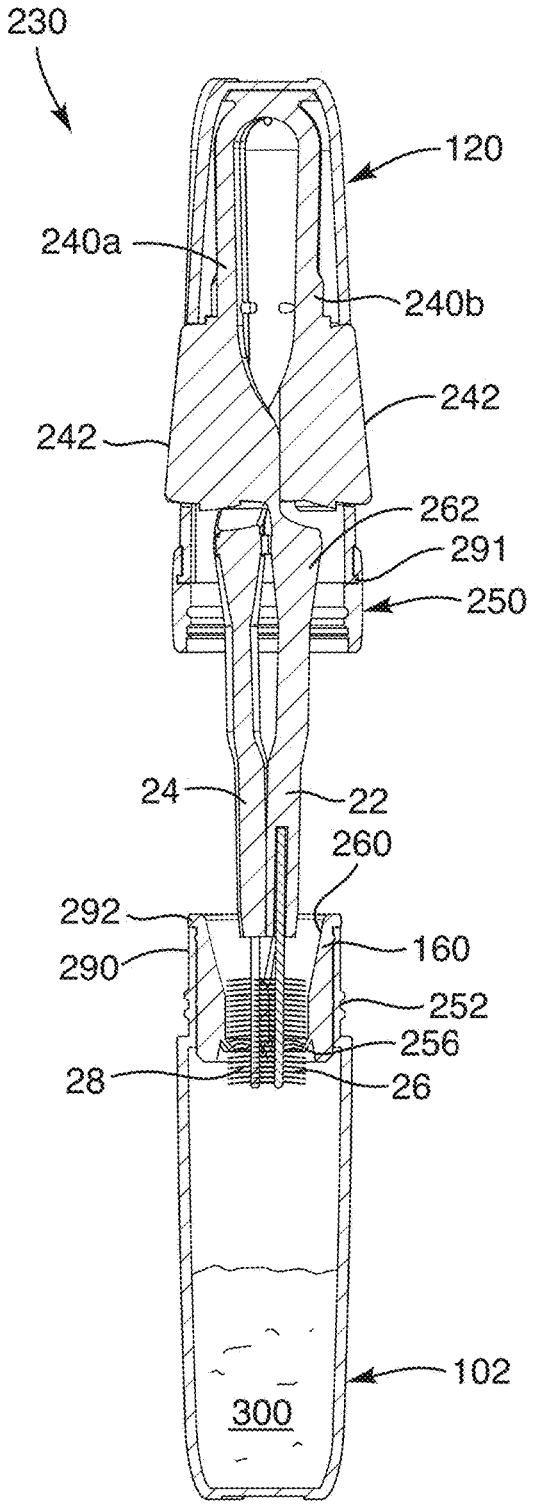
FIG. 61 is a side, elevation, cross-sectional view thereof with the brushes partially withdrawn through the squeegee tool thus redistributing the product held by the bristles of the brush, removing access, and evenly distributing that product properly for use by a user.

Referring to FIG. 61, the process of withdrawing the cap 120 with its integrated arms 240*a*, 240*b* and wands 22, 24 passes all the bristles of the brushes 26, 28 through the wipers 256 at the most constricted portion of the ports 162. This action and movement have several very beneficial results.

First, the bristles bend and distort downward as they are drawn through the wipers 256. Thus, the brushes 26, 28 must actually bend their bristles downward in order to even pass through the wipers 256. This motion compresses bristles together tightly, which tends to extrude and remove excess product 300 from between the bristles of each brush 26, 28, leaving only a thin layer of product 300 on bristles, and some quantity between bristles of the brushes 26, 28. This also means any excess is basically wiped off the outer circumference of brushes 26, 28 by the wipers 256 and returned into the receptacle 102 with the main body of the product 300.

Figure 62A:
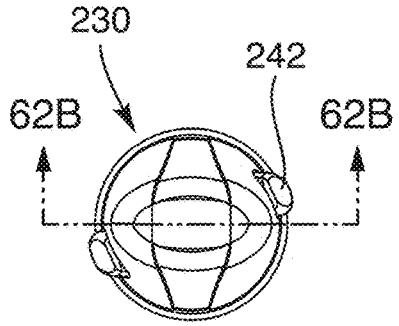
FIG. 62A is a top, elevation view thereof.
Figure 62B:
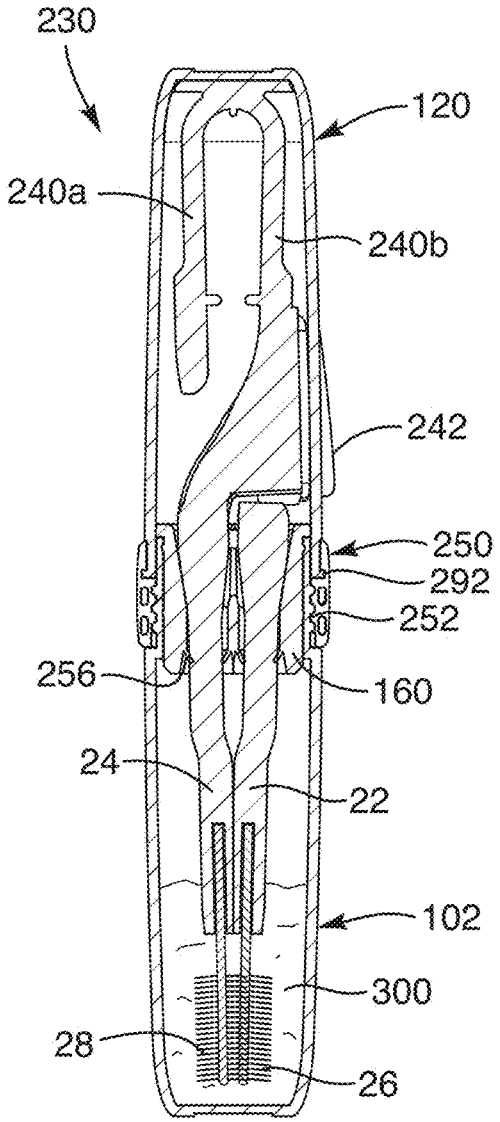
FIG. 62B is a side, elevation, cross-sectional view of an apparatus in accordance with the invention in which the wands and brushes are in a closed position, naturally biased toward one another, with the tapered seal portion of the wands firmly sealing openings or ports in the squeegee tool, and the cap portion or handle portion of the container sealing against the softer material of the rim of the squeegee tool, and sealing that rim of the squeegee tool against the upper edge or lip of the receptacle portion of the container.

FIG. 62A illustrates the cross section of the arms 240*a*, 240*b* and wands 22, 24. In the illustrated embodiment of FIG. 62B, the cross section cut line described in FIG. 62A. Thus, in the illustration of FIG. 62B, the crossover of the arms 240*a*, 240*b* is clarified.

Referring to FIGS. 63 through 64, the operation in the hands of a user appears in the open position and the closed position, respectively, of the brushes 26, 28. For example, following withdrawal of the wands 22, 24 and brushes 26, 28 as illustrated in FIG. 61, FIG. 63 illustrates how a user applies finger and thumb pressure against the actuators 242, moving the arms 240*a*, 240*b* and the wands 22, 24 apart. Thus, as illustrated hereinabove, the brushes 26, 28 are separated in order to be closed down onto an eyelash for application of product 300 to the eyelash 98.

Referring to FIG. 64, releasing the actuation force or pressure on the actuators 242 by the finger and thumb of a user results in closure of the brushes 26, 28 together. The user now has fingers free to move the handle 120 or cap 120 away from the user's face, drawing the brushes 26, 28 along the eyelash. Likewise, an important function for a user is the ability to rotate the handle 120 or cap 120 in order to follow the curvature of an eyelash 98 with the bristles of the brushes 26, 28 in contact with the eyelash 98. In this context, the word "lash" is used to mean all of the individual lashes or lash hairs constituting an upper or a lower eyelash corresponding to an eyelid of a user.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus operable as an applicator for mascara, the apparatus comprising:

a container comprising a handle fitted to a receptacle holding a product as makeup to be applied to lashes of a user, the handle and receptacle selectively securable together and sealable in a closed position, unsealed in an intermediate position, and completely separable for use in an open position;

wands, each comprising a brush and an insert, the insert as a stopper tapering toward the brush, the wands secured to the handle and paired to receive the product onto the brushes in at least one of the closed position and the intermediate position, the brushes being positionable to apply the product to the lashes of the user in the open position; and a wiper, comprising receivers, acting as sockets tapered toward apertures, corresponding thereto, to match the inserts to provide vapor proof sealing of the product inside the receptacle;

wherein the wands are shaped and sized to move away from one another during withdrawal from the receptacle between the closed position and the open position.

2. The apparatus of claim 1, wherein at least one of the inserts and the receivers comprises an elastomeric material sufficiently flexible to effect the vapor proof sealing to the other of the receiver and insert.

3. The apparatus of claim 2, wherein the elastomeric material is selected to relieve a tolerance of fit between the inserts and the receivers.

4. The apparatus of claim 1, wherein the apertures and wands are shaped to separate the brushes for loading the product onto the brushes.

5. The apparatus of claim 1, wherein the wands and apertures are sized and shaped to separate the brushes from one another in the intermediate position.

6. The apparatus of claim 1, wherein the brushes each comprise bristles, and the apertures are sized and shaped to redistribute the product more uniformly around the brushes by compressing together the bristles during extraction thereof from the receptacle between the closed and open positions.

7. The apparatus of claim 1, wherein the apertures and the brushes are sized and shaped to remove excess amounts of the product from and outer circumference of each of the brushes while passing through the apertures.

8. The apparatus of claim 1, wherein the wands are shaped to separate the brushes in the intermediate position and relax in compliance with a biasing force in the closed position.

9. The apparatus of claim 1, wherein the wiper and the wands are shaped to release the brushes into contact with one another in the closed and open positions and to separate the brushes in the intermediate position.

10. An apparatus comprising:

a container comprising a handle fitted to a receptacle holding mascara;

the handle and receptacle selectively securable and separable with respect to one another in a closed position, open position, and intermediate position therebetween, the handle and receptacle being completely separable for use in the open position;

wands, each comprising a brush and an insert, the insert acting as a stopper, the stopper tapering toward the brush constructed to receive the mascara thereonto;

the wands, shaped to position the brushes together in the closed and open positions, and apart in the intermediate position; and a wiper, comprising receivers as sockets tapered toward respective apertures as ports therein capable of passing the wands therethrough, each receiver of the receivers fitted to a corresponding insert of the inserts and forming a vapor proof seal between the corresponding insert and the each receiver in the closed position.

11. The apparatus of claim 10, wherein at least one of the inserts and the receivers comprises an elastomeric material sufficiently flexible to conform to the other of the receivers and inserts to effect the vapor proof seal.

12. The apparatus of claim 11, wherein the elastomeric material is selected to relieve a tolerance of fit between the inserts and the receivers.

13. The apparatus of claim 12, wherein an elasticity of the elastomeric material is selected to seal in response to closure of the container.

14. The apparatus of claim 13, wherein the elastomeric material is softer than material located adjacent to it.

15. The apparatus of claim 14, wherein the wands are shaped and sized to move away from one another during withdrawal from the receptacle between the closed position and the open position.

16. The apparatus of claim 15, wherein the wands and apertures are sized and shaped to separate the brushes from one another in the intermediate position.

17. The apparatus of claim 16, wherein:

the brushes each comprise bristles; and the apertures are sized and shaped to redistribute the mascara more uniformly around the brushes by compressing together the bristles, and to remove excess mascara from the circumference of the brushes, all simultaneously during extraction of the brushes through the wiper between the closed and open positions.

18. The apparatus of claim 17, wherein the wands are shaped to separate the brushes in the intermediate position and relax in compliance with a biasing force in the closed position.

19. The apparatus of claim 18, wherein:

the wiper and the wands are shaped to release the brushes into contact with one another in the closed and open positions and to separate the brushes in the intermediate position; and multiple seals are provided along the wands at multiple locations between the receptacle and the handle.

* * * * *